US007461926B2

(12) United States Patent
Sugahara

(10) Patent No.: US 7,461,926 B2
(45) Date of Patent: Dec. 9, 2008

(54) LIQUID DELIVERING APPARATUS AND METHOD OF PRODUCING THE SAME

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 137 days.

(21) Appl. No.: 10/944,797

(22) Filed: Sep. 21, 2004

(65) Prior Publication Data

US 2005/0068376 A1 Mar. 31, 2005

(30) Foreign Application Priority Data

Sep. 29, 2003 (JP) ..... 2003-338124
Jul. 29, 2004 (JP) ..... 2004-222111

(51) Int. Cl.
*B41J 2/045* (2006.01)

(52) U.S. Cl. ..... 347/68; 347/70

(58) Field of Classification Search ..... 347/68–72, 347/18

See application file for complete search history.

(56) References Cited

U.S. PATENT DOCUMENTS 5,850,240 A 12/1998 Kubatzki et al.
6,229,704 B1 * 5/2001 Hoss et al. ..... 361/704
6,378,996 B1 * 4/2002 Shimada et al. ..... 347/68
6,386,672 B1 * 5/2002 Kimura et al. ..... 347/18
6,439,702 B1 * 8/2002 Karlinski ..... 347/70
6,471,341 B1 10/2002 Yoshimura et al.
6,532,028 B1 3/2003 Gailus et al.
2003/0025768 A1 * 2/2003 Koike et al. ..... 347/68
2003/0030705 A1 2/2003 Koike et al.

FOREIGN PATENT DOCUMENTS

EP 0 733 480 A1 9/1996
EP 1 116 588 A1 7/2001
EP 1 277 583 A2 1/2003
JP A-5-169655 7/1993
JP A 8-258274 10/1996
JP A-2001-88303 4/2001

* cited by examiner

*Primary Examiner*—Matthew Luu
*Assistant Examiner*—Lisa M Solomon
(74) *Attorney, Agent, or Firm*—Oliff & Berridge, PLC

(57) ABSTRACT

A liquid delivering apparatus, including a flow-passage unit including an opening and a pressure chamber which accommodates liquid and which communicates with the opening; an oscillating plate which partially defines the pressure chamber; a piezoelectric material layer which is one of directly and indirectly stacked on the oscillating plate and which deforms upon application of an electric field thereto so as to oscillate the oscillating plate for delivering the liquid from the pressure chamber through the opening; and an electrode pattern and a drive circuit which apply the electric filed to the piezoelectric material layer. The drive circuit and the electrode pattern are one of directly and indirectly provided on the oscillating plate.

22 Claims, 17 Drawing Sheets

LIQUID DELIVERING APPARATUS AND METHOD OF PRODUCING THE SAME

The present application is based on Japanese Patent Application No. 2003-338124 filed Sep. 29, 2003, and No. 2004-222111 filed Jul. 29, 2004, the contents of which are incorporated herein by reference.

BACKGROUND OF THE INVENTION

1. Field of the Invention

The present invention relates in general to a liquid delivering apparatus and a method of producing the same. In particular, the present invention relates to a liquid delivering apparatus which utilizes a piezoelectric material and a method of producing such an apparatus.

2. Discussion of Related Art

There is known a liquid delivering apparatus such as an ink-jet recording head, which includes a flow-passage unit in which a plurality of pressure chambers are formed, an oscillating plate which constitutes a part of the wall of each pressure chamber, and a piezoelectric material layer stacked on the oscillating plate so as to oscillate the oscillating plate for permitting liquid in the pressure chambers to be ejected from nozzles respectively communicating with the pressure chambers. Electrodes are superposed on the piezoelectric material layer to apply an electric field to the piezoelectric material layer. Each electrode is connected, via a wiring member such as FPC (Flexible Print Circuit) or tab terminals, to a drive circuit (driver IC) which is provided separately from the flow-passage unit and which has a function of generating actuating signals for actuating the piezoelectric material layer. Such a liquid delivering apparatus is disclosed in U.S. Pat. No. 6,471,341 corresponding to JP-A-8-258274, for instance.

SUMMARY OF THE INVENTION

Where the wiring member such as the FPC or tab terminals is provided between the electrodes formed on the piezoelectric material layer and the external drive circuit as described above, however, the cost of the components and the cost required in a process of connecting the components are increased, inevitably pushing up the cost of manufacture of the device. Further, the conventional arrangement requires a space in which the wiring member such as the FPC or tab terminals is disposed for connecting the electrodes and the drive circuit to each other, so that the device tends to be large-sized.

It is therefore a first object of the present invention to provide a liquid delivering apparatus which assures a simplified wiring structure between a piezoelectric material layer and a drive circuit.

It is a second object of the present invention to provide a method of producing the liquid delivering apparatus.

At least the first object indicated above may be achieved according to a first aspect of the invention, which provides a liquid delivering apparatus comprising a flow-passage unit including an opening and a pressure chamber which accommodates liquid and which communicates with the opening; an oscillating plate which partially defines the pressure chamber; a piezoelectric material layer which is stacked, either directly or indirectly, on the oscillating plate and which deforms upon application of an electric field thereto so as to oscillate the oscillating plate for delivering the liquid from the pressure chamber through the opening; and an electrode pattern and a drive circuit which apply the electric filed to the piezoelectric material layer. The drive circuit and the electrode pattern are provided, either directly or indirectly, on the oscillating plate.

In the liquid delivering apparatus constructed as described above wherein the drive circuit and the electrode pattern for applying the electric field to the piezoelectric material layer are provided, either directly or indirectly, on the oscillating plate, the wiring structure between the electrode pattern and the drive circuit can be simplified. In other words, the present arrangement eliminates the wiring member such as the FPC or tab terminals conventionally used for connecting the electrodes formed on the piezoelectric material layer and the drive circuit, resulting in a reduction in the cost of the components and the cost required in the process of connecting the components, for instance. In addition, the present arrangement does not require a space in which the wiring member such as the FPC or tab terminals is to be disposed for connecting the electrodes and the drive circuit, so that the size of the apparatus can be reduced.

The second object indicated above may be achieved according to a second aspect of the invention, which provides a method of producing a liquid delivering apparatus comprising a flow-passage unit including an opening and a pressure chamber which accommodates liquid and which communicates with the opening, an oscillating plate which is bonded to the flow-passage unit and which partially defines the pressure chamber, a piezoelectric material layer which is formed, either directly or indirectly, on the oscillating plate and which deforms upon application of an electric field thereto so as to oscillate the oscillating plate for delivering the liquid from the pressure chamber through the opening. The method comprises forming a plurality of processed plate members by employing a blanking method in which a metal plate member is subjected to a blanking operation, each of the plurality of processed plate members including a frame member, a flow-passage-unit forming plate which partially constitutes the flow-passage unit and which is separably integrated to the frame member, and a heat-dissipating-member forming plate which partially provides a heat-dissipating member and which is separably integrated to the frame member; forming an integral body in which at least a portion of the flow-passage unit and the heat dissipating member are bonded to one of opposite surfaces of the oscillating plate, the integral body being formed by stacking the plurality of processed plate members and the oscillating plate on each other; forming at least an electrode pattern and the piezoelectric material layer on the other of the opposite surfaces of the oscillating plate in a predetermined order; mounting a drive circuit on the other of the opposite surfaces of the oscillating plate; and separating the flow-passage-unit-forming plates and the heat-dissipating-member-forming plates from the respective frame members.

According to the method described above, the flow-passage-unit forming plates which constitute the at least a portion of the flow-passage unit and the heat-dissipating-member-forming plates which constitute the heat dissipating member can be simultaneously bonded to the oscillating plate, thereby reducing the number of process steps required for producing the apparatus.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 14 are views schematically showing states of the liquid delivering apparatus of FIG. 7 in various steps during the process of producing the apparatus, wherein

FIG. 15 are views schematically showing states of the liquid delivering apparatus of FIG. 7 in various steps during the process of producing the liquid delivering apparatus of FIG. 7, wherein

DETAILED DESCRIPTION OF THE PREFERRED EMBODIMENTS

First Embodiment

Figure 1:
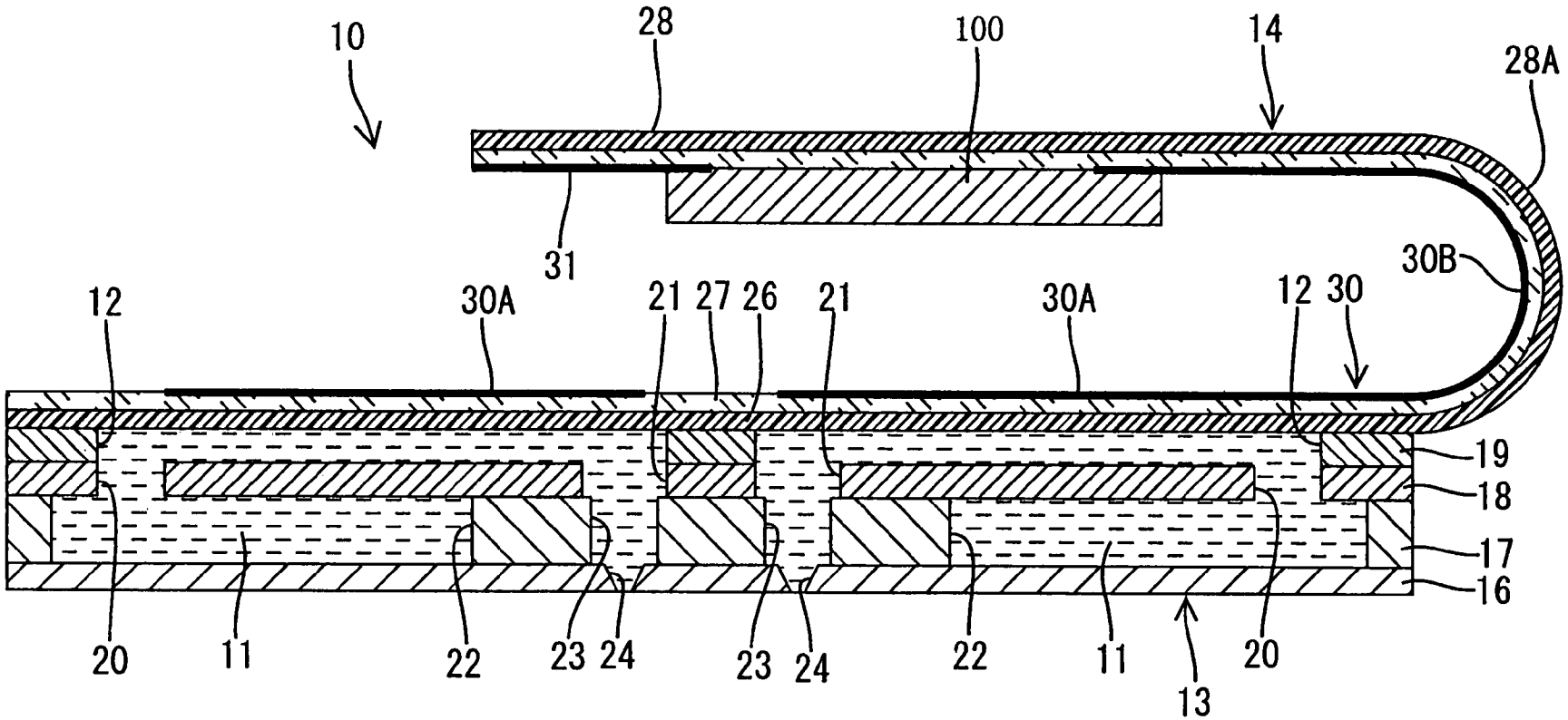
FIG. 1 is a cross sectional view of a liquid delivering apparatus constructed according to a first embodiment of the invention, taken along the longitudinal direction of pressure chambers.

By referring first to FIGS. 1-4, there will be described a first embodiment of the present invention. FIG. 1 shows a liquid delivering apparatus 10 to which the present invention is applied. The liquid delivering apparatus 10 is used as an ink-jet recording head 10 for an ink-jet printer (not shown). As shown in FIG. 1, the ink-jet recording head 10 constructed according to a first embodiment of the invention includes: a flow-passage unit 13 which includes a plurality of pressure chambers 12 in which ink 11 (corresponding to "liquid" in the invention) is accommodated; and an actuator plate 14 which is superposed on and bonded to the flow-passage unit 13 so as to close the pressure chambers 12.

The flow-passage unit 13 has a generally rectangular planar shape and includes four plates, i.e., a nozzle plate 16, a manifold plate 17, a flow-passage plate 18, and a pressure-chamber plate 19. These four plates 16, 17, 18, 19 are stacked in this order and bonded to one another by an epoxy-type thermosetting adhesive.

Figure 2:
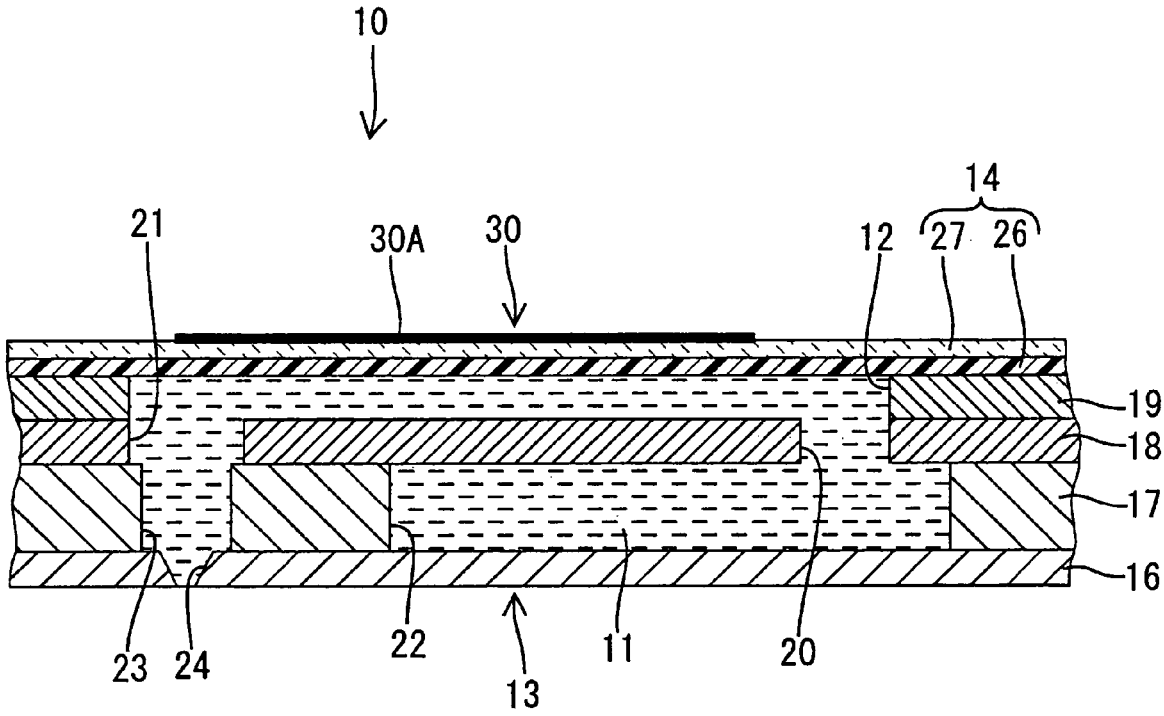
FIG. 2 is a fragmentary enlarged view of the liquid delivering apparatus of FIG. 1 in cross section taken along the longitudinal direction of the pressure chambers.
Figure 3:
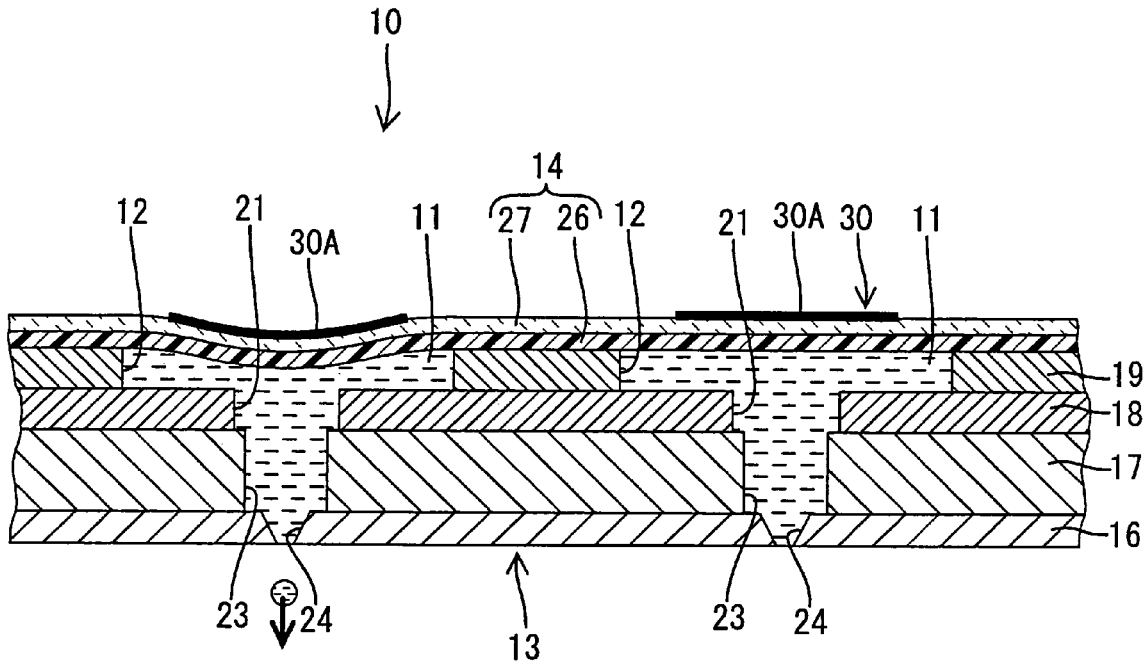
FIG. 3 is a fragmentary enlarged view of the liquid delivering apparatus of FIG. 1 in cross section taken along a direction parallel to the rows of the pressure chambers.

The pressure-chamber plate 19 is formed of a metal material such as stainless steel and has two rows of the plurality of pressure chambers 12. The two rows of the pressure chambers 12 are arranged in a staggered or zigzag manner in a longitudinal direction of the flow-passage unit 13 (i.e., in a direction perpendicular to the sheet surface of FIGS. 1 and 2). Each of the pressure chambers 12 has an elongate shape which extends in a widthwise direction of the flow-passage unit 13 (i.e., a transverse direction as seen in FIGS. 1 and 2). The flow-passage plate 18 is also formed of a metal material such as stainless steel and has manifold passages 20 and pressure passages 21 formed through the thickness thereof. Each manifold passage 20 and each pressure passage 21 respectively communicate with one and the other of longitudinally opposite ends of the corresponding elongate pressure chamber 12. The manifold plate 17 is also formed of a metal material such as stainless steel and has a manifold 22 which communicates with an ink tank (not shown) and nozzle passages 23 which are connected to the respective pressure passages 21. The nozzle plate 16 is formed of a polyimide-type synthetic resin material and has ink ejection nozzles 24 (corresponding to "opening" in the invention) which are connected to the respective nozzle passages 23 and from which the ink 11 is ejected. The nozzles 24 are arranged in two rows in the longitudinal direction of the flow-passage unit 13. The ink supplied from the ink tank to the manifold 22 is distributed to the pressure chambers 12 via the manifold passages 20, and delivered to the nozzles 24 via the pressure passages 21 and the nozzle passages 23. Thus, there are formed ink flow passages in the flow-passage unit 13 of the liquid delivering apparatus 10.

The actuator plate 14 includes an oscillating plate 26 which partially defines each pressure chamber 12, in other words, which constitutes a part of the wall of each pressure chamber 12, and a piezoelectric material layer 27 which is stacked directly on the entirety of one of opposite surfaces (the upper surface) of the oscillating plate 26 that is remote from the pressure chambers 12. (In this description, "directly" means there are no intervening layers or any intervening material is in a limited area between the object being mounted an the surface to which mounted.) The oscillating plate has a generally rectangular shape and is formed of an electrically conductive metal material such as stainless steel. The length of the short side of the oscillating plate 26 is substantially equal to the length of the long side of the flow-passage unit 13 which is parallel to the rows of the nozzles 24 while the length of the long side of the oscillating plate 26 is substantially two times that of the short side of the flow-passage unit 13. An approximately half portion of the oscillating plate 26, as viewed in the longitudinal direction thereof, is bonded to the upper surface of the pressure-chamber plate 19 by the epoxy-type thermosetting adhesive, so as to cover the entirety of the upper surface of the flow-passage unit 13. Another half portion of the oscillating plate 26, as viewed in the longitudinal direction thereof, extends from one of opposite long side edges of the flow-passage unit 13, in other words, from one long side edge of the flow-passage unit 13 which is parallel to the rows of the pressure chambers 12, so as to function as an extending portion 28. The oscillating plate 26 is connected to the ground of a drive circuit (IC) 100 which will be described and functions as a lower electrode.

The piezoelectric material layer 27 is formed of a ferroelectric piezoelectric ceramic material such as lead zirconium titanate (PZT) and stacked directly on the entire surface of the oscillating plate 26 with a uniform thickness. The piezoelectric material layer 27 may be formed directly on the oscillating plate 26 by an aerosol deposition (AD) method, for instance. Alternatively, the piezoelectric material layer made of a green sheet may be bonded directly to the oscillating plate 26 by an electrically conductive adhesive agent. Further, there may be employed a piezoelectric-layer forming process or method (i.e., a sol-gel method) which comprises applying a material solution for forming the piezoelectric layer 27 to the oscillating plate 26 as a base and heating the applied solution.

The oscillating plate 26 is provided with an electrode pattern 30 and the drive circuit (IC) 100 for applying an electric filed to the piezoelectric material layer 27. The drive circuit (IC) 100 is an integrated circuit having a function of generating actuating signals for actuating the piezoelectric material layer 27. The drive circuit (IC) 100 has a generally rectangular planar shape and is bonded by soldering to the oscillating plate 26 in the vicinity of a distal end portion of the extending portion 28 of the oscillating plate 26 via the electrode pattern 30 on the piezoelectric material layer 27 as described below.

Figure 4:
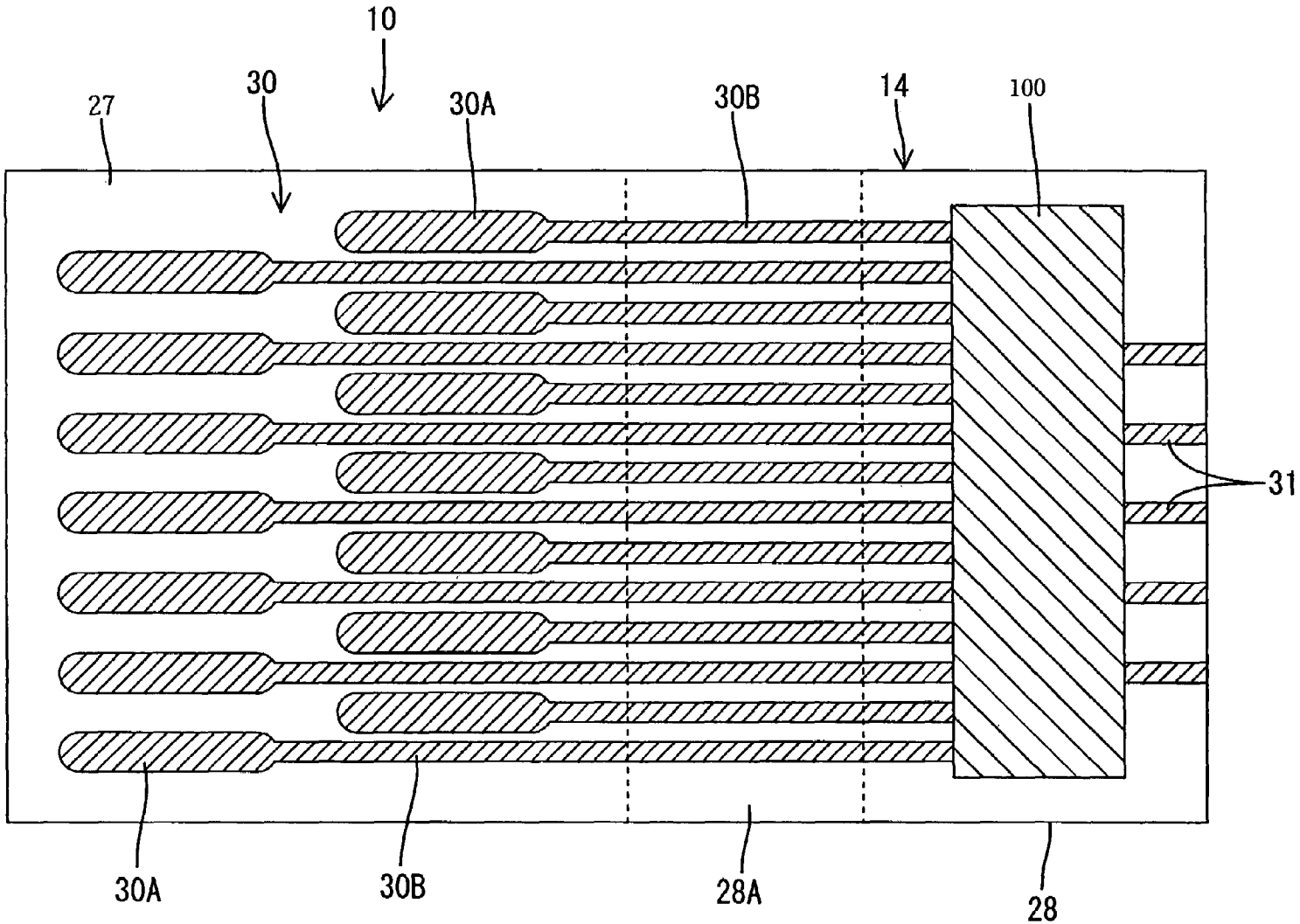
FIG. 4 is a developed plan view of the liquid delivering apparatus of FIG. 1.

The electrode pattern 30 is formed, on the piezoelectric material layer 27, by printing a thin-film like conductor in a predetermined shape and includes a plurality of upper electrodes 30A and a plurality of connecting portions 30B. Described in detail, the electrode pattern 30 includes a plurality of electrode pieces which respectively correspond to the plurality of pressure chambers 12. Each electrode piece includes one upper electrode 30A and one connecting portion 30B. As shown in FIG. 4, the upper electrodes 30A are formed so as to be superposed on the piezoelectric material layer 27 at respective positions thereof corresponding to the respective pressure chambers 12. Each upper electrode 30A has an elongate oval shape whose size is slightly or somewhat smaller than that of each pressure chamber 12 in their plan view. Each connecting portion 30B extends from one of opposite longitudinal ends of the corresponding upper electrode 30A toward the distal end portion of the extending portion 28 of the oscillating plate 26. The connecting portions 30B are arranged in the longitudinal direction of the flow-passage unit 13 so as to be spaced apart from each other at a predetermined spacing pitch. Each connecting portion 30B is connected by soldering to the drive circuit (IC) 100 at its one of opposite ends remote from the corresponding upper electrode 30A.

A plurality of external electrodes 31 are formed at the distal end portion of the extended portion 28 of the oscillating plate 26, i.e., on one of opposite sides of the drive circuit (IC) 100 which is remote from the electrode pattern 30. The external electrodes 31 are formed, on the piezoelectric material layer 27, by printing a thin-film like conductor, and arranged in the longitudinal direction of the flow-passage unit 13 so as to be spaced apart from each other at a predetermined spacing pitch. Each external electrode 31 is connected by soldering to the drive circuit (IC) 100 at its one of opposite ends. The number of the external electrodes 31 is smaller than the number of the electrode pieces of the electrode pattern 30 (that is equal to the number of the pressure chambers 12). In FIG. 4, five external electrodes 31 are shown. The external electrodes 31 are connected to a control circuit (not shown) of the printer, via the FPC, etc.

The piezoelectric material layer 27 formed on the oscillating plate 26 is subjected to a polarization treatment so as to be polarized in the direction of thickness thereof. When the potential of an arbitrary upper electrode 30A (and the corresponding connecting portion 30B) is made higher by the drive circuit (IC) 100 than that of the oscillating plate 26 as the lower electrode, an electric field is applied to a portion of the piezoelectric material layer 27 which corresponds to the arbitrary upper electrode 30A, in the direction of polarization (i.e., in the direction of thickness of the piezoelectric material layer 27). Accordingly, the above-indicated portion of the piezoelectric material layer 27 expands in the direction of thickness of the same 27 and contracts in a direction parallel to a surface of the same 27. Thus, as shown in the left part of the FIG. 3, the portions of the piezoelectric material layer 27 and the oscillating plate 26 corresponding to the upper electrode 30A are (namely, a portion of the actuator plate 14 is) deformed into a convex shape which protrudes toward the corresponding pressure chamber 12. Namely, the actuator plate 14 undergoes local deformation (i.e., unimorph deformation). Accordingly, the volume of the pressure chamber 12 is decreased and the pressure of the ink 11 in that chamber 12 is accordingly increased, whereby the ink 11 is ejected from the corresponding nozzle 24 communicating with that chamber 12. Subsequently when the potential of the upper electrode 30A is made equal to that of the oscillating plate 26 as the lower electrode, the deformed portions of the piezoelectric material layer 27 and the oscillating plate 26 return to the initial or original flat shape, and the volume of the pressure chamber 12 returns to its initial or original value, so that the ink 11 is sucked into the pressure chamber 12 from the manifold 22.

As shown in FIG. 1, the extending portion 28 of the oscillating plate 26 is folded at a folding portion 28A adjacent to the flow-passage unit 13 such that the folding portion 28A is curved into a generally "U" shape in cross section and such that the distal end portion of the extending portion 28 is opposed to the flow-passage unit 13. According to this arrangement, the drive circuit (IC) 100, which is provided indirectly on the distal end portion of the extending portion 28 of the oscillating plate 26 with the piezoelectric material layer 27 therebetween, is located over the flow-passage unit 13 so as to be opposed to the same 13. (For purposes of this detailed description, "indirectly" is defined as overlying or positioned over a layer surface but having one or more complete or substantially complete layers of material between the layer surface and the object "indirectly on".) In this arrangement, there is no large difference between the size (area) of the liquid delivering apparatus 10 as a whole in its plan view (as seen in a direction perpendicular to the plane of the flow-passage unit 13) and the size (area) of the flow-passage unit 13 in its plan view. Described in detail, the size of the entire apparatus 10 in its plan view is larger than that of the flow-passage unit 13 in its plan view, by an amount corresponding to the size of the folding portion 28A which protrudes from one long side of the flow-passage unit 13.

Next, there will be explained a method of producing the liquid delivering apparatus 10 according to the first embodiment.

Initially, the piezoelectric material layer 27 is formed on the oscillating plate 26 by (1) an aerosol deposition (AD) method; (2) a piezoelectric-layer forming process or method (sol-gel method); or (3) a bonding process or method.

Where the piezoelectric material layer 27 is formed by the aerosol deposition method, an aerosol chamber is filled with a piezoelectric material such as fine particles of the lead zirconium titanate (PZT), and the fine particles are agitated or stirred. Subsequently, a carrier gas such as a nitrogen gas or a helium gas is introduced into the aerosol chamber, so that the fine particles are floated in the gas to produce an aerosol. The thus produced aerosol is sprayed at a high speed from a nozzle onto the oscillating plate 26 formed of stainless steel, for instance, and deposited on the surface of the oscillating plate 26 to provide the piezoelectric material film.

Where the piezoelectric material layer 27 is formed by the piezoelectric-layer forming method (sol-gel method), metal alkoxide of the piezoelectric material is subjected to hydrolysis and polycondensation in a solution system. Where the piezoelectric material layer 27 is formed of the lead zirconium titanate (PZT), there is employed, as a material solution, a solution in which lead acetate trihydrate, zirconium propoxide, and titanium isopropoxide are dissolved in methoxy ethanol, for instance. The solution is applied to the oscillating plate 26 as a base by spin coating to provide a thin layer thereon, and the applied solution is dried and heated. By repeating the application of the solution and drying and heating the applied solution, the piezoelectric material layer 27 having a desired thickness is formed on the oscillating plate 26.

Where the piezoelectric material layer 27 is formed by the bonding method, a substrate or base plate formed of alumina, for instance, is coated with a slurry solution in which ceramic powder such as the PZT is mixed with and dispersed in binder resin, to thereby provide a green sheet. After the green sheet has been fired, the fired sheet is divided by using a dicer into pieces having a predetermined shape. Subsequently, one of opposite surfaces of a sheet piece of the piezoelectric material is coated with an electrically conductive adhesive, and the oscillating plate 26 as a base is pressed onto the adhesive-coated surface of the sheet piece. Thereafter, the oscillating plate 26 to which the sheet piece of the piezoelectric material is attached is separated from the substrate, so that the sheet piece of the piezoelectric material bonded to the oscillating plate 26 is removed from the substrate. Thus, the piezoelectric layer 27 is formed on the oscillating plate 26.

In the methods described above, the piezoelectric layer 27 is formed by using the PZT as the piezoelectric material. The piezoelectric material for forming the piezoelectric layer 27 is not limited to the PZT, but there may be used any other piezoelectric material such as barium titanate, lead titanate, and Rochelle salt.

Subsequently, the electrode pattern 30 is formed on the upper surface of the thus formed piezoelectric material layer 27. Where the electrode pattern 30 is formed by a photolithography etching method, a conductor layer is initially formed on the upper surface of the piezoelectric material layer 27. Then, a resist film formed of photosensitive resin is formed on the upper surface of the conductor layer. Then, to the resist film, an ultraviolet ray (UV ray) is applied through a photomask in which a prescribed pattern is formed, so that the pattern is printed on the resist film. After the exposure to the UV ray, portions of the resist film which have not been exposed to the UV ray and remain soluble are dissolved with a developing solution. By using the thus formed pattern of the resist film as an etching mask, portions of the conductor layer which are not covered with the resist film are etched, to thereby form the desired pattern corresponding to the electrode pattern 30 on the piezoelectric material layer 27. The electrode pattern 30 may be otherwise formed. For instance, the electrode pattern 30 may be printed directly on the piezoelectric material layer 27. Alternatively, after the conductor layer is formed on the piezoelectric material layer 27, the conductor layer may be divided or formed into a desired pattern corresponding to the electrode pattern 30 by using laser.

After the electrode pattern 30 has been formed as described above, there is applied, between the upper electrodes 30A and the oscillating plate 26 as the lower electrode, an electric field which is stronger than that applied when a usual ink ejection operation is carried out, so that the piezoelectric layer 27 interposed between the upper and lower electrodes is polarized in the direction of thickness thereof.

Next, the drive circuit (IC) 100 is attached to the oscillating plate 26 with the piezoelectric material layer 27 therebetween. The drive circuit (IC) 100 is fixed by reflow soldering, for instance, to the connecting portions 30B of the electrode pattern 30 and the external electrodes 31 on the piezoelectric material layer 27.

In the meantime, the nozzle plate 16, the manifold plate 17, the flow-passage plate 18, and the pressure-chamber plate 19 are stacked on and bonded to one another with those plates 16-19 being positioned relative to one another. In the plates 16, 17, 18, 19, there are suitably formed in advance, by etching, holes corresponding to the nozzles 24, the manifold 22, etc.

Then, the actuator plate 14 and the flow-passage unit 13 are superposed on and bonded to each other with the oscillating plate 26 of the actuator plate 14 being positioned relative to the upper surface of the pressure-chamber plate 19 of the flow-passage unit 13. Thereafter, the extending portion 28 of the oscillating plate 26 which extends or protrudes from the flow-passage unit 13 is folded so as to be opposed to the flow-passage unit 13 such that the drive circuit (IC) 100 fixed to the extending portion 28 via the piezoelectric layer 27 is located above the flow-passage unit 13. Thus, the liquid delivering apparatus 10 is produced.

In the liquid delivering apparatus 10 constructed according to the illustrated first embodiment, the drive circuit (IC) 100 is mounted indirectly on the extending portion 28 of the oscillating plate 26 with the piezoelectric material layer 27 therebetween, which extending portion 28 extends from the flow-passage unit 13, and the extending portion 28 is folded so as to be opposed to the flow-passage unit 13. According to the arrangement, the area of the entire apparatus 10 in its plan view can be made small, leading to a reduction in the size of the printer case or frame (not shown) in which the apparatus 10 is disposed.

Since the extending portion 28 extends from the long side of the rectangular flow-passage unit 13 which is parallel to the rows of the pressure chambers 12, it is possible to increase the spacing pitch of the connecting portions 30B of the electrode pattern 30 which extend between the driver circuit (IC) 100 and the upper electrodes 30A on the flow-passage unit 13.

In the liquid delivering apparatus 10 according to the illustrated first embodiment, the oscillating plate 26 is formed of the conductive material, and the electric field is applied between the oscillating plate 26 and the electrode pattern 30 which is formed so as to be superposed on the piezoelectric material layer 27. According to this arrangement, the oscillating plate 26 functions as an electrode which is common to all of the pressure chambers 12. In the present embodiment, in particular, the piezoelectric material layer 27 is formed so as to be present between the electrode pattern 30 and the oscillating plate 26, so that the piezoelectric material layer 27 functions as an electrically insulating layer which electrically insulates the electrode pattern 30 and the oscillating plate 26 from each other.

Where the pressure chamber 12 is actuated by deforming the piezoelectric material layer 27, it is needed to form a piezoelectric material layer at least on a portion of a region of the oscillating plate 26, which region corresponds to the pressure chamber 12. (Hereinafter, the above-indicated portion of a region of the oscillating plate 26 is referred to as "piezoelectric-material-layer-indispensable portion".) In the present embodiment wherein the liquid delivering apparatus 10 includes the plurality of pressure chambers 12, it is needed to form a piezoelectric material layer at least on each of portions of regions, which regions respectively correspond to the plurality of pressure chambers 12, namely, at least on each of a plurality of piezoelectric-material-layer-indispensable portions which respectively correspond to the plurality of pressure chambers 12. In view of this, in the present embodiment, the single piezoelectric material layer 27 is formed on the entirety of the upper surface of the oscillating plate 26 as a continuous region which includes the plurality of piezoelectric-material-layer indispensable portions.

The piezoelectric material layer may be otherwise formed. For instance, a piezoelectric material layer may be formed only on a single region (one region) which constitutes a part of the entire upper surface of the oscillating plate 26, which part includes the plurality of piezoelectric-material-layer indispensable portions described above. Alternatively, a plurality of piezoelectric material layers may be formed respectively on a plurality of regions each of which includes each of the plurality of indispensable portions. The piezoelectric material layer may be formed according to arrangements other than described above.

Described more specifically, a single piezoelectric material layer may be formed so as to be present between the entirety of the electrode pattern 30 and the oscillating plate 26. Alternatively, a plurality of piezoelectric material layers may be formed such that each of the plurality of piezoelectric material layers is present only between each of a plurality of electrode pieces of the electrode pattern 30 and the oscillating plate 26. In these arrangements, any portions of all electrode pieces of the electrode pattern 30 are prevented from directly contacting the oscillating plate 26, thereby avoiding an electrical short between the electrode pieces and the oscillating plate 26.

Where the piezoelectric material layer 27 is formed on the oscillating plate 26 by the aerosol deposition method, the piezoelectric material layer 27 can be formed in a relatively short period of time.

Where the piezoelectric material layer 27 is formed by the piezoelectric-layer forming process or method (sol-gel method) in which the material solution is applied to the oscillating plate 26 and the applied solution is heated, the piezoelectric material layer 27 can be uniformly formed on the oscillating plate 26.

Where the piezoelectric material layer 27 is formed by the bonding method in which the fired green sheet is bonded to the oscillating plate 26, the oscillating plate 26 is prevented from being damaged by formation of the piezoelectric material layer 27 thereon.

Second Embodiment

Figure 5:
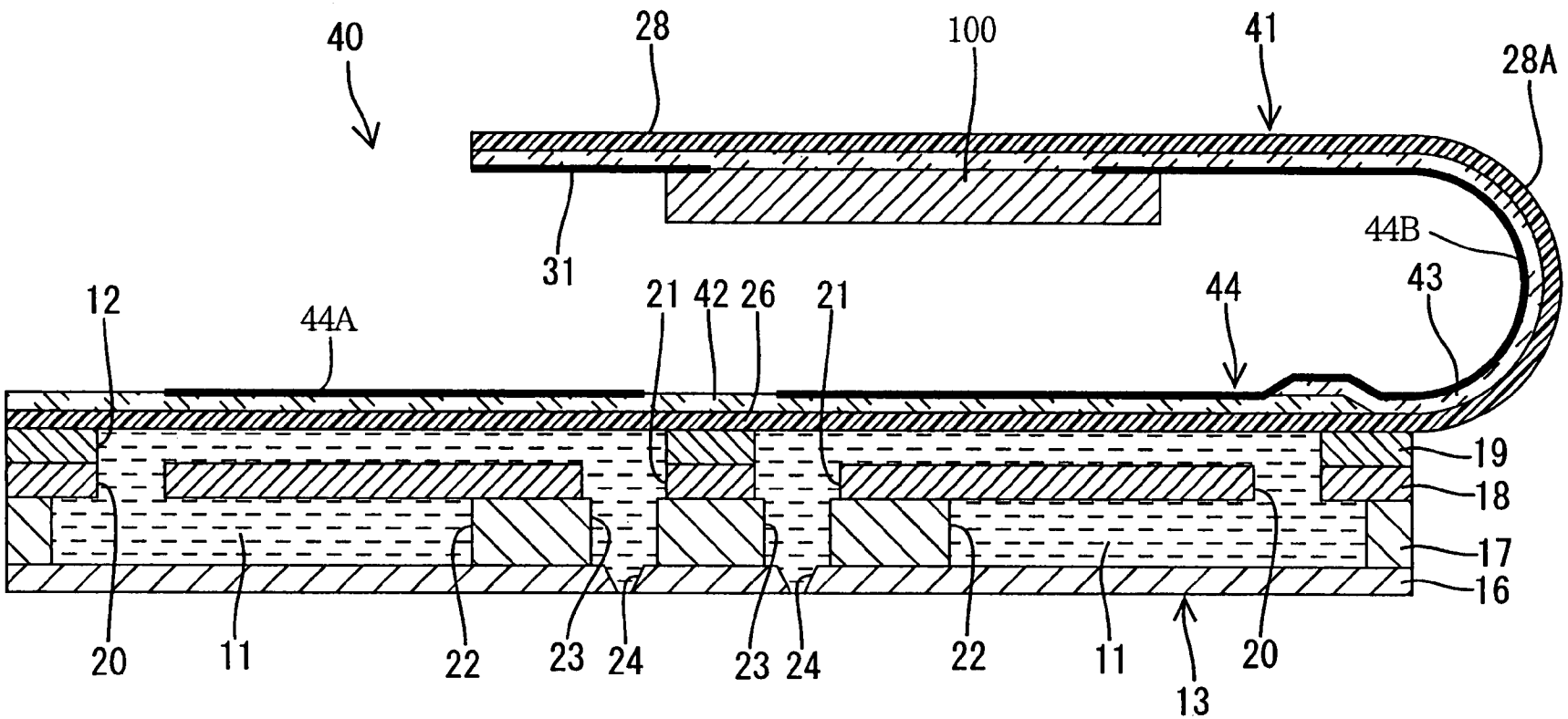
FIG. 5 is a cross sectional view of a liquid delivering apparatus constructed according to a second embodiment of the invention, taken along the longitudinal direction of the pressure chambers.

By referring next to FIG. 5, there will be described a liquid delivering apparatus 40 constructed according to a second embodiment of the invention. In this second embodiment, the same reference numerals as used in the illustrated first embodiment are used to identify the corresponding components, and a detailed explanation of which is dispensed with.

In the liquid delivering apparatus 40 constructed according to this second embodiment, a piezoelectric material layer 42 is formed on a first half area of the upper surface of the oscillating plate 26 which corresponds to the flow-passage unit 13, while an insulating layer 43 made of synthetic resin, for instance, is formed on a second half area of the upper surface of the oscillating plate 26 which corresponds to the extending portion 28. An electrode pattern 44 is formed so as to extend over the first area of the oscillating plate 26 on which the piezoelectric material layer 42 is formed and the second area of the oscillating plate 26 on which the insulating layer 43 is formed. The electrode pattern 44 includes a plurality of upper electrodes 44A and a plurality of connecting portion 44B. The structure of the electrode pattern 44 is similar to that of the electrode pattern 30 in the first embodiment.

In the present liquid delivering apparatus 40, the oscillating plate 26 is formed of the conductive material and the electrode pattern 44 is provided so as to extend over both of the piezoelectric material layer 42 and the insulating layer 43 which are formed on the oscillating plate 26. According to this arrangement, the region of the piezoelectric material layer 42 (which is ferroelectric) sandwiched by and between the electrode pattern 44 and the oscillating plate 26 can be reduced, so that the electrostatic capacity between the electrode pattern 44 and the oscillating plate 26 is decreased.

In the present embodiment, the piezoelectric material layer 42 may be formed so as to be superposed at least on each of portions of regions of the oscillating plate 26, which regions respectively correspond to the plurality of pressure chambers 12, namely at least on each of a plurality of piezoelectric-material-layer indispensable portions. Described in detail, a piezoelectric material layer may be formed, for instance, on a single region which includes the plurality of indispensable portions. Alternatively, a plurality of piezoelectric material layers may be formed respectively on a plurality of regions each of which includes each of the plurality of piezoelectric-material-indispensable portions. Where the piezoelectric material layer/layers is/are formed as described above, the insulating layer 43 may be formed on at least a portion of a region of the oscillating plate 26 on which the piezoelectric material layer/layers is/are not formed. (Hereinafter, this region is referred to as "non piezoelectric-material-layer forming region".) In other words, the insulating layer 43 may be formed at least on a portion of the non piezoelectric-material-layer forming region, which portion corresponds to the electrode pattern 44. Described in detail, a single insulating layer may be formed on a single region which covers a plurality of portions of the non piezoelectric-material-layer forming region, which portions respectively correspond to the plurality of electrode pieces of the electrode pattern 44. Alternatively, a plurality of insulating layers may be formed respectively on the plurality of portions of the non piezoelectric-material-layer forming region, which portions respectively correspond to the plurality of electrode pieces of the electrode pattern 44. In these arrangements, any portions of all electrode pieces of the electrode pattern 44 are prevented from directly contacting the oscillating plate 26, thereby avoiding an electrical short between the electrode pieces and the oscillating plate 26.

Third Embodiment

Figure 6:
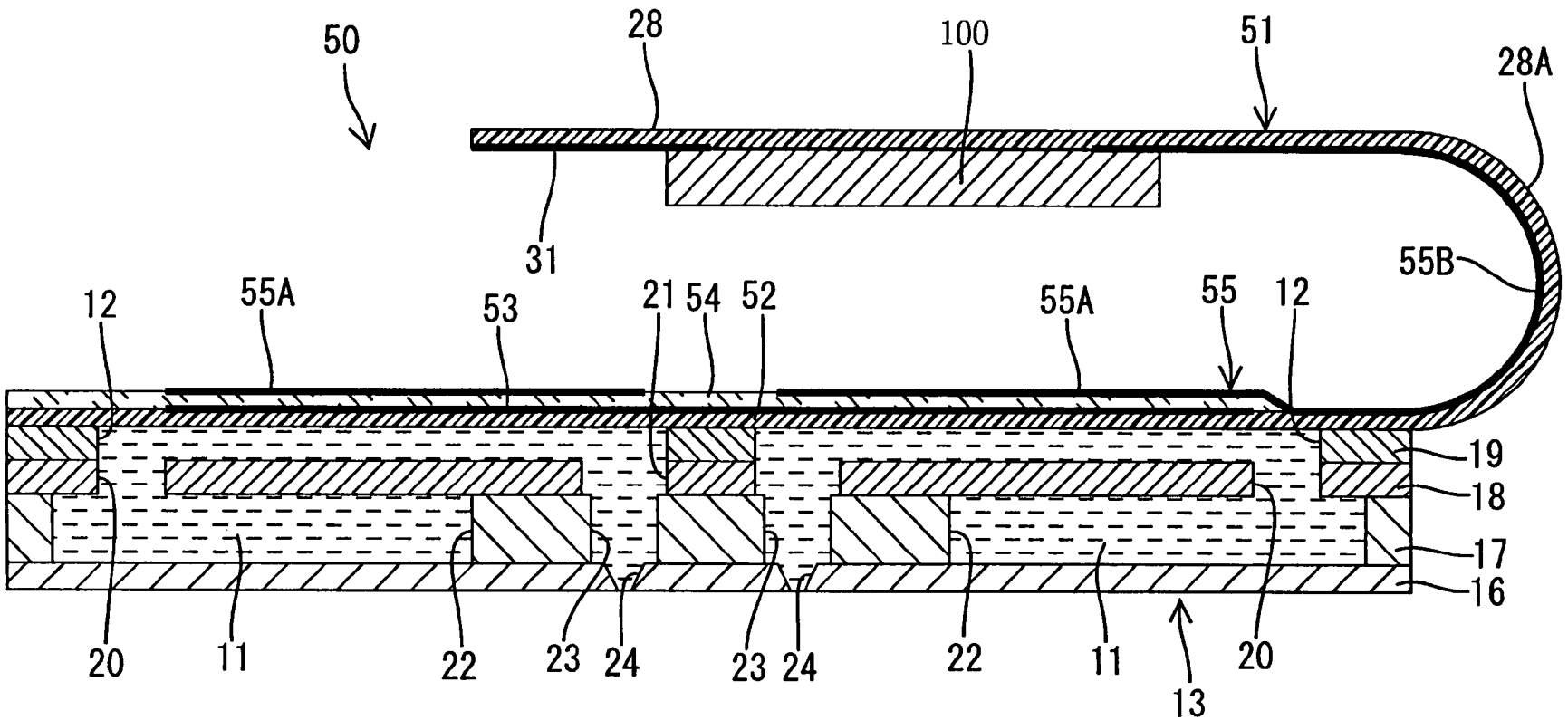
FIG. 6 is a cross sectional view of a liquid delivering apparatus constructed according to a third embodiment of the invention, taken along the longitudinal direction of the pressure chambers.

There will be next explained a liquid delivering apparatus 50 constructed according to a third embodiment of the invention by referring to FIG. 6. In this third embodiment, the same reference numerals as used in the illustrated first embodiment are used to identify the corresponding components, and a detailed explanation of which is not given.

In the liquid delivering apparatus 50 of this third embodiment, an oscillating plate 52 of an actuator plate 51 is formed of an insulating material such as polyimide synthetic resin. On an upper surface of the oscillating plate 52, there is formed a lower electrode 53. Described in detail, the lower electrode 53 is in the form of a single continuous layer formed at least on a region of the oscillating plate 52 which includes the piezoelectric-material-layer indispensable portions thereof corresponding to the respective pressure chambers 12. The lower electrode 53 is connected, via a connecting portion (not shown) formed on the oscillating plate 52, to the ground of the drive circuit (IC) 100 which is directly mounted on the extending portion 28 (directly as used in this description means in contact with the layer on which mounted as noted earlier). A piezoelectric material layer 54 is formed indirectly on an approximately half area of the upper surface of the oscillating plate 52 which corresponds to the flow-passage unit 13, such that the piezoelectric material layer 54 cooperates with the oscillating plate 52 to sandwich the lower electrode 53 therebetween, although in this case, at some peripheral areas the piezoelectric material layer 54 may be directly over and in contact with the oscillating plate 52. On the thus formed piezoelectric material layer 54, there is formed an electrode pattern 55 which includes a plurality of upper electrodes 55A and a plurality of connecting portions 55B. Described more specifically, the electrode pattern 55 includes a plurality of electrode pieces which correspond to the respective pressure chambers 12 and each of which includes one upper electrode 55A which is formed at a position on the piezoelectric material layer 54 that corresponds to the corresponding pressure chamber 12 and one connecting portion 55B which extends from the upper electrode 55A so as to extend over the extending portion 28 of the oscillating plate 52 and be connected to the drive circuit (IC) 100.

In the present liquid delivering apparatus 50 wherein the oscillating plate 52 is formed of the insulating material, it is not necessary to provide any insulating structure or arrangement between the connecting portions 55B of the electrode pattern 55 and the extending portion 28 of the oscillating plate 52.

In the present embodiment, the piezoelectric material layer 54 may be formed so as to be indirectly superposed at least on each of portions of regions of the oscillating plate 52, which regions respectively correspond to the plurality of pressure chambers 12. The details are explained in the illustrated first and second embodiments. To prevent an electrical short between all electrode pieces of the electrode pattern 55 and the lower electrode 53, it is desirable that a plurality of piezoelectric material layers are formed respectively at least on a plurality of regions in each of which each of the plurality of electrode pieces of the electrode pattern 55 and the lower electrode 53 overlap each other, or it is desirable that a single piezoelectric material layer is formed at least on a single region which includes the above-indicated plurality of overlapping regions. Where the piezoelectric material layer is not formed on a portion of any of the plurality of overlapping regions, an insulating layer may be formed on that portion, so as to avoid an electrical short between the corresponding electrode piece and the lower electrode 53.

Fourth Embodiment

By referring next to FIGS. 7-15, there will be described a liquid delivering apparatus 60 constructed according to a fourth embodiment of the invention. The liquid delivering apparatus 60 of this fourth embodiment is also used for an ink-jet recording head of an ink-jet printer (not shown). In the following description, the same reference numerals as used in the illustrated first embodiment are used so as to identify the substantially corresponding components, and a detailed explanation of which is dispensed with.

Figure 7:
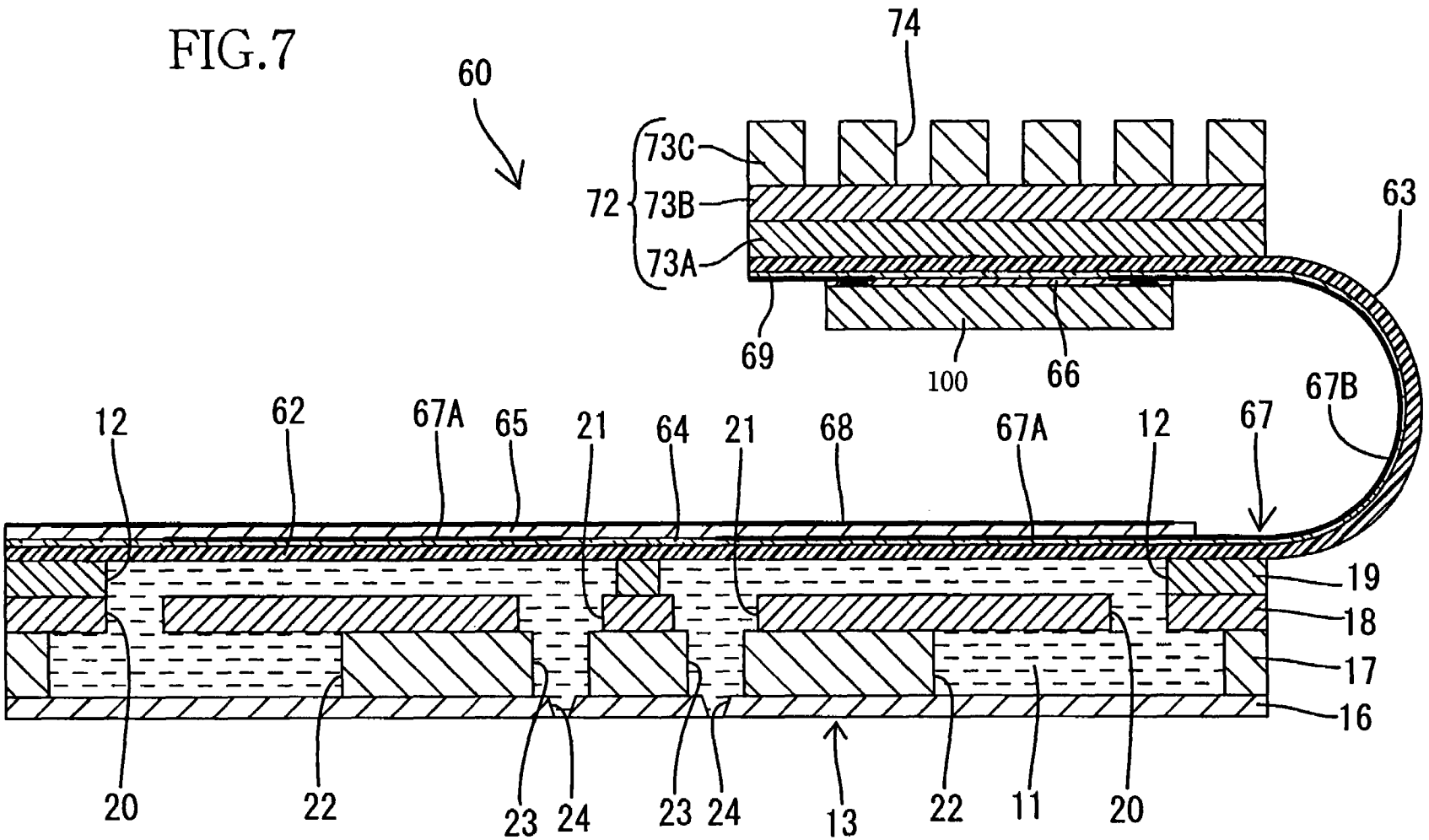
FIG. 7 is a cross sectional view of a liquid delivering apparatus constructed according to a fourth embodiment of the invention, taken along the longitudinal direction of the pressure chambers.

As shown in FIG. 7, the liquid delivering apparatus 60 includes a generally rectangular oscillating plate 62 formed of an electrically conductive metal material such as stainless steel. The flow-passage unit 13 is bonded to one of opposite surfaces of the oscillating plate 62 (i.e., the lower surface of the same 62). The oscillating plate 62 includes an extending portion 63 which extends from one long side of the flow-passage unit 13 which is parallel to the rows of the nozzles 24. The extending portion 63 is folded in a generally U-shape such that its distal end portion is opposed to the flow-passage unit 13. An insulating layer 64 is formed so as to be superposed on the entirety of the other of the opposite surfaces of the oscillating plate 62 (i.e., the upper surface of the same 62) which is opposite to the above-indicated one surface thereof to which the flow-passage unit 13 is bonded. This insulating layer 64 is formed of a ceramic material such as alumina, having an electrically insulating property and a high degree of thermal conductivity. A piezoelectric material layer 65 is formed so as to be superposed on the substantially entirety of a portion of the upper surface of the insulating layer 64, which portion corresponds to the flow-passage unit 13, such that the piezoelectric material layer 65 cooperates with the insulating layer 64 to sandwich an electrode pattern 67 (which will be described) therebetween. Further, the drive circuit (IC) 100 is bonded by an insulating adhesive 66 to the distal end portion of the extending portion 63 of the oscillating plate 62 via the insulating layer 64 formed on the extending portion 63.

Figure 8:
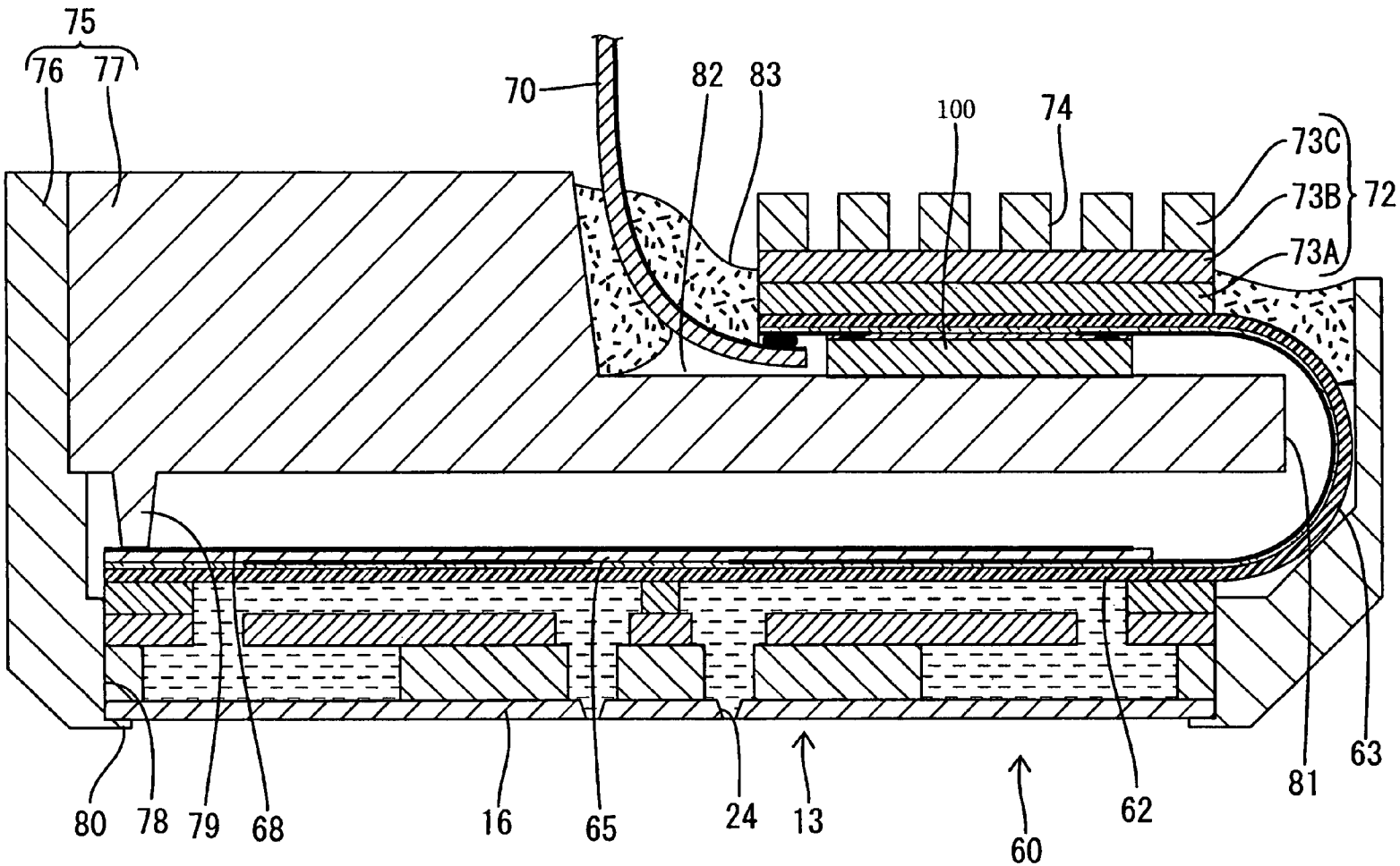
FIG. 8 is a cross sectional view of an ink-jet recording head which includes the liquid delivering apparatus of FIG. 7, taken along the longitudinal direction of the pressure chambers.

On the upper surface of the insulating layer 64, there is formed the electrode pattern 67 which includes a plurality of lower individual electrodes 67A and a plurality of connecting portions 67B. Described more specifically, the electrode pattern 67 includes a plurality of electrode pieces which correspond to the respective pressure chambers 12 and each of which includes one lower individual electrode 67A which is formed at a position on the insulating layer 64 that corresponds to the corresponding pressure chamber 12 and one connecting portion 67B which extends from the lower individual electrode 67A such that it extends over the extending portion 63 of the oscillating plate 62 and is connected to the drive circuit (IC) 100 by soldering. On the substantially entirety of the upper surface of the piezoelectric material layer 65, there is formed an upper common electrode 68 (corresponding to "upper electrode" in the invention). A connecting portion (not shown) is formed on the upper surface of the insulating layer 64 such that it extends from the upper common electrode 68 over the extending portion 63 of the oscillating plate 62 so as to be connected to the ground of the drive circuit (IC) 100 by soldering. Further, a plurality of external electrodes 69 which are connected to the drive circuit (IC) 100 are formed at the distal end portion of the extending portion 63. As shown in FIG. 8, to the plurality of external electrodes 69, there is connected by soldering an FPC (Flexible Print Circuit) 70 for connecting the drive circuit (IC) 100 and a control circuit (not shown) of the printer to each other.

At the distal end portion of the extending portion 63, a heat dissipating member 72 is formed on the above-indicated one of opposite surfaces of the oscillating plate 62 which surface is located on one of opposite sides of the oscillating plate 62 nearer to the flow-passage unit 13 and is opposite to the other surface of the oscillating plate 62 on which the drive circuit (IC) 100 is mounted with the insulating layer 64 therebetween. The heat dissipating member 72 is provided to permit heat generated from the driver circuit (IC) 100 to be dissipated. The heat dissipating member 72 comprises three metal plates which are superposed on the oscillating plate 62 so as to be bonded to one another and each of which has a rectangular shape having a size slightly or somewhat larger than that of the drive circuit (IC) 100. In the present embodiment, the three metal plates which constitute the heat dissipating member 72 are a first heat dissipating plate 73A, a second heat dissipating plate 73B, and a third heat dissipating plate 73C which are superposed on the oscillating plate 62 in order. The heat dissipating member 72 has a laminar structure similar to a laminar structure which includes the plates 19, 18, 17 and which constitutes a portion of the flow-passage unit 13. In other words, the first heat dissipating plate 73A is formed of a metal plate which is made of the same metal material as that of a metal plate for the pressure-chamber plate 19 and which has the same thickness as that of the metal plate for the pressure-chamber plate 19. The second heat dissipating plate 73B is formed of a metal plate which is made of the same metal material as that of a metal plate for the flow-passage plate 18 and which has the same thickness as that of the metal plate for the flow-passage plate 18. The third heat dissipating plate 73C is formed of a metal plate which is made of the same metal material as that of a metal plate for the manifold plate 17 and which has the same thickness as that of the metal plate for the manifold plate 17. The third heat dissipating plate 73C which provides an outermost surface of the heat dissipating member 72 is formed with a plurality of heat dissipating recesses 74 each in the form of a groove, so as to extend in a direction along the long side of the flow-passage unit 13 parallel to the rows of the nozzles 24.

The thus constructed liquid delivering apparatus 60 is accommodated in a casing 75, as shown in FIG. 8. The casing 75 is formed of synthetic resin, for instance, and includes an outer member 76 and an inner member 77 which engage each other. The outer member 76 is a frame-like shape which is open upwards and downwards. The flow-passage unit 13 is fitted within a lower opening 78 having a rectangular shape and formed in the lower surface of the outer member 76, whereby the liquid delivering apparatus 60 is held by the outer member 76 with the nozzle plate 16 being exposed to the outer surface of the casing 75. The inner member 77 is a generally plate member and fitted within the outer member 76 so as to cover the upper opening of the outer member 76. The inner member 77 has at its inner surface a protruding portion 79 which protrudes toward the flow-passage unit 13 such that its distal end abuts on the upper surface of the upper common electrode 68. The outer member 76 has a supporting portion 80 formed at the periphery of the lower opening 78 so as to protrude inwards. The nozzle plate 16 is held in abutting contact with the upper surface of the supporting portion 80. The flow-passage unit 13 is positioned relative to the casing 75 in the vertical direction by being sandwiched by and between the protruding portion 79 and the supporting portion 80. Between the outer member 76 and the inner member 77, there is formed an insertion hole 81 extending in the vertical direction. The folding part of the extending portion 63 of the oscillating plate 62 is inserted through the insertion hole 81, so that the distal end portion of the extending portion 63 is located over the flow-passage unit 13. The inner member 77 has a stepped installation recess 82 formed on its upper surface. The distal end portion of the extending portion 63 of the oscillating plate 62 is bonded to the installation recess 82 by an adhesive 83 in a posture in which the drive circuit IC (100) is held in abutting contact with the bottom surface of the installation recess 82 while the heat dissipating member 72 is exposed to the exterior of the casing 75.

Next, there will be explained a method of producing the liquid delivering apparatus 60 by referring to FIGS. 9-15.

Figure 9:
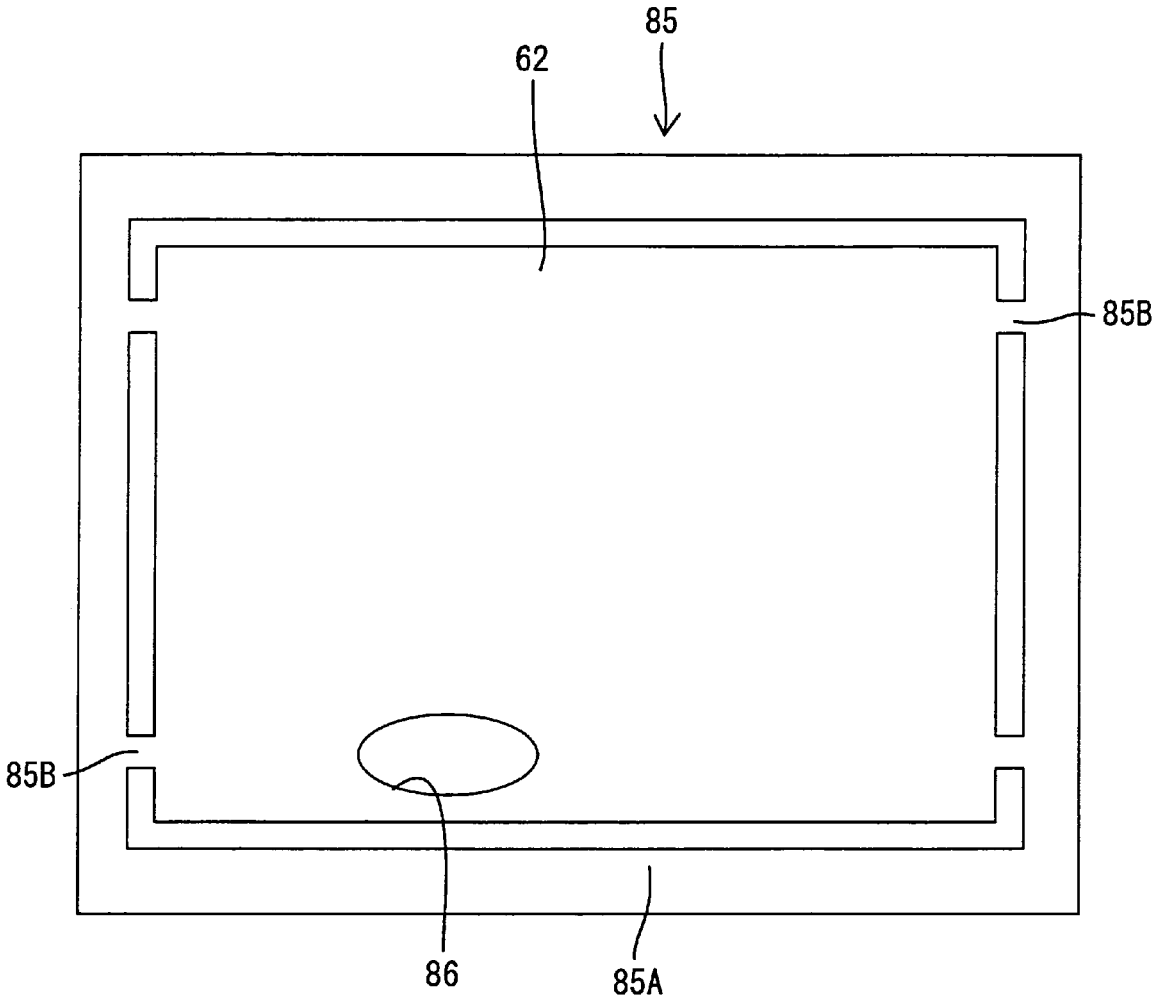
FIG. 9 is a plan view of a plate member which constitutes an oscillating plate.

Initially, there is formed a plate member 85 shown in FIG. 9, by performing a blanking operation carried out by etching, on a metal plate as a pre-processed member of the oscillating plate 62. The plate member 85 includes a rectangular oscillating plate 62 and a rectangular frame member 85A surrounding the oscillating plate 62. The oscillating plate 62 and frame member 85A are connected to each other by a plurality of connecting portions 85B. The oscillating plate 62 is formed with an ink supply hole 86 through which the ink is introduced from the external ink tank (not shown) to the manifold 22.

Figure 10:
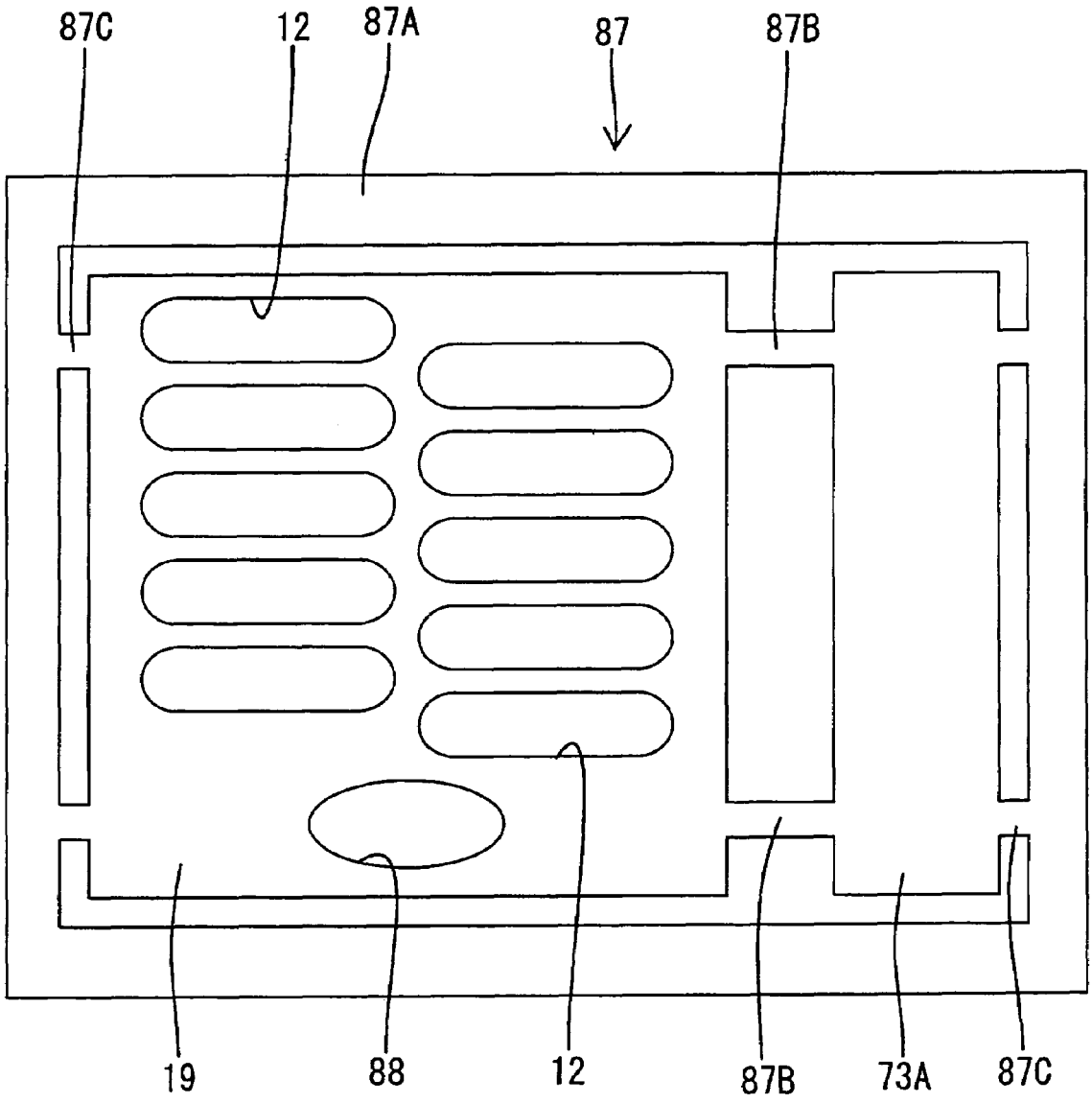
FIG. 10 is a plan view of a plate member which constitutes a pressure-chamber plate and a first heat dissipating member.

Similarly, there is formed a plate member 87 shown in FIG. 10, by performing a blanking operation carried out by etching, on a metal plate as a pre-processed member of the pressure-chamber plate 19. The plate member 87 includes the pressure-chamber plate 19, the first heat dissipating plate 73A, and a rectangular frame member 87A which are connected integrally to each other by a plurality of connecting portions 87B, 87C. In the plate member 87, the positional relationship between the pressure-chamber plate 19 and the first heat dissipating plate 73A in a state in which they are integral with the frame member 87A is the same as that when the liquid delivering apparatus 60 is in a state in which the oscillating plate 62 is in a flat posture without being folded. The pressure-chamber plate 19 is formed with the plurality of pressure chambers 12 arranged in a zigzag or staggered fashion and an ink supply hole 88 through which the ink is introduced from the exterior to the manifold 22.

Figure 11:
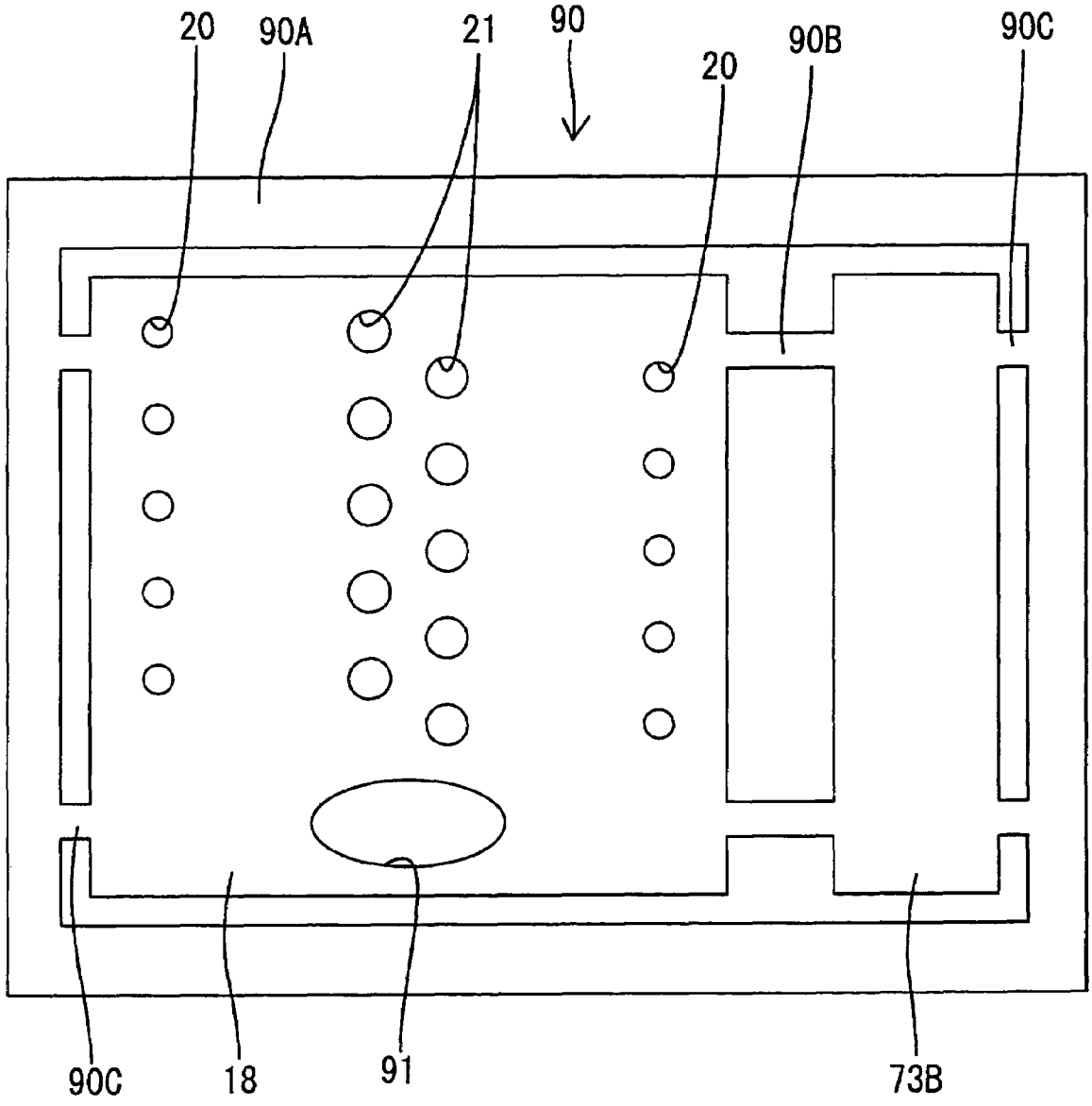
FIG. 11 is a plan view of a plate member which constitutes a flow-passage plate and a second heat dissipating plate.

Similarly, there is formed a plate member 90 shown in FIG. 11, by performing a blanking operation carried out by etching, on a metal plate as a pre-processed member of the flow-passage plate 18. The plate member 90 includes the flow-passage plate 18, the second heat dissipating plate 73B, and a rectangular frame member 90A which are connected integrally to each other by a plurality of connecting portions 90B, 90C. In the plate member 90, the positional relationship between the flow-passage plate 18 and the second heat dissipating plate 73B is the same as that when the liquid delivering apparatus 60 is in a state in which the oscillating plate 62 is in a flat posture without being folded. The flow-passage plate 18 is formed with the manifold passages 20 and the pressure passages 21 corresponding to the respective pressure chambers 12, and an ink supply hole 91 which communicates with the manifold 22.

Figure 12:
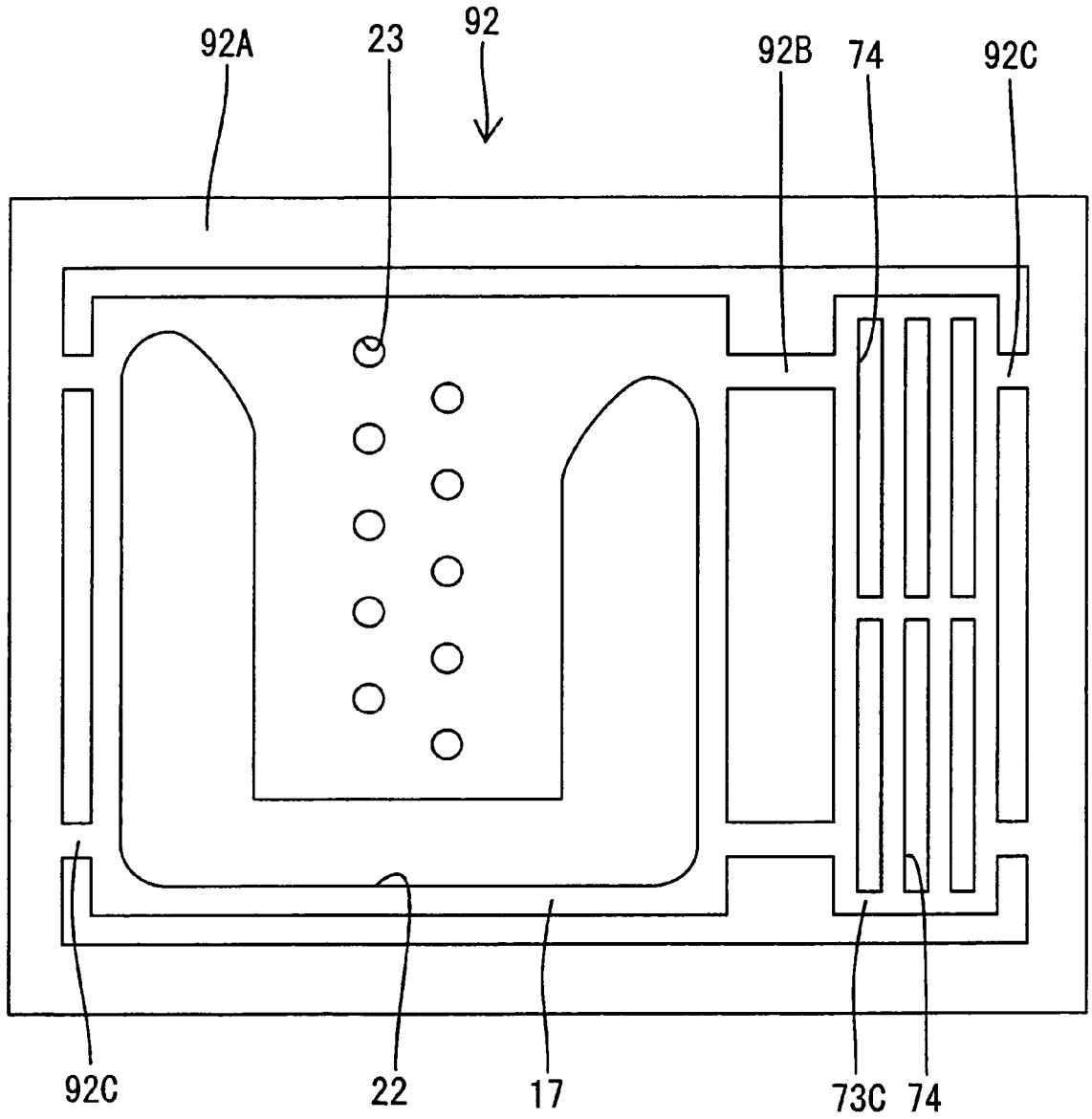
FIG. 12 is a plan view of a plate member which constitutes a manifold plate and a third heat dissipating plate.

Similarly, there is formed a plate member 92 shown in FIG. 12, by performing a blanking operation carried out by etching, on a metal plate as a pre-processed member of the manifold plate 17. The plate member 92 includes the manifold plate 17, the third heat dissipating plate 73C, and a rectangular frame member 92A which are connected integrally to each other by a plurality of connecting portions 92B, 92C. In the plate member 92, the positional relationship between the manifold plate 17 and the third heat dissipating plate 73C is the same as that when the liquid delivering apparatus 60 is in a state in which the oscillating plate 62 is in a flat posture without being folded. The manifold plate 17 is formed with the manifold 22 which communicates with the external ink tank via the ink supply holes 86, 88, 91, and the nozzle passages 23 which are connected to the respective pressure passages 21. The third heat dissipating plate 73C is formed with the plurality of heat dissipating recesses 74. The plate members 87, 90, 92 correspond to "the processed plate members" in the invention, the manifold plate 17, the flow-passage plate 18, and the pressure-chamber plate 19 correspond to "the flow-passage-unit forming plates" in the invention, and the first, second, and third heat dissipating plates 73A, 73B, 73C correspond to "the heat-dissipating-member forming plates" in the invention.

Figure 13:
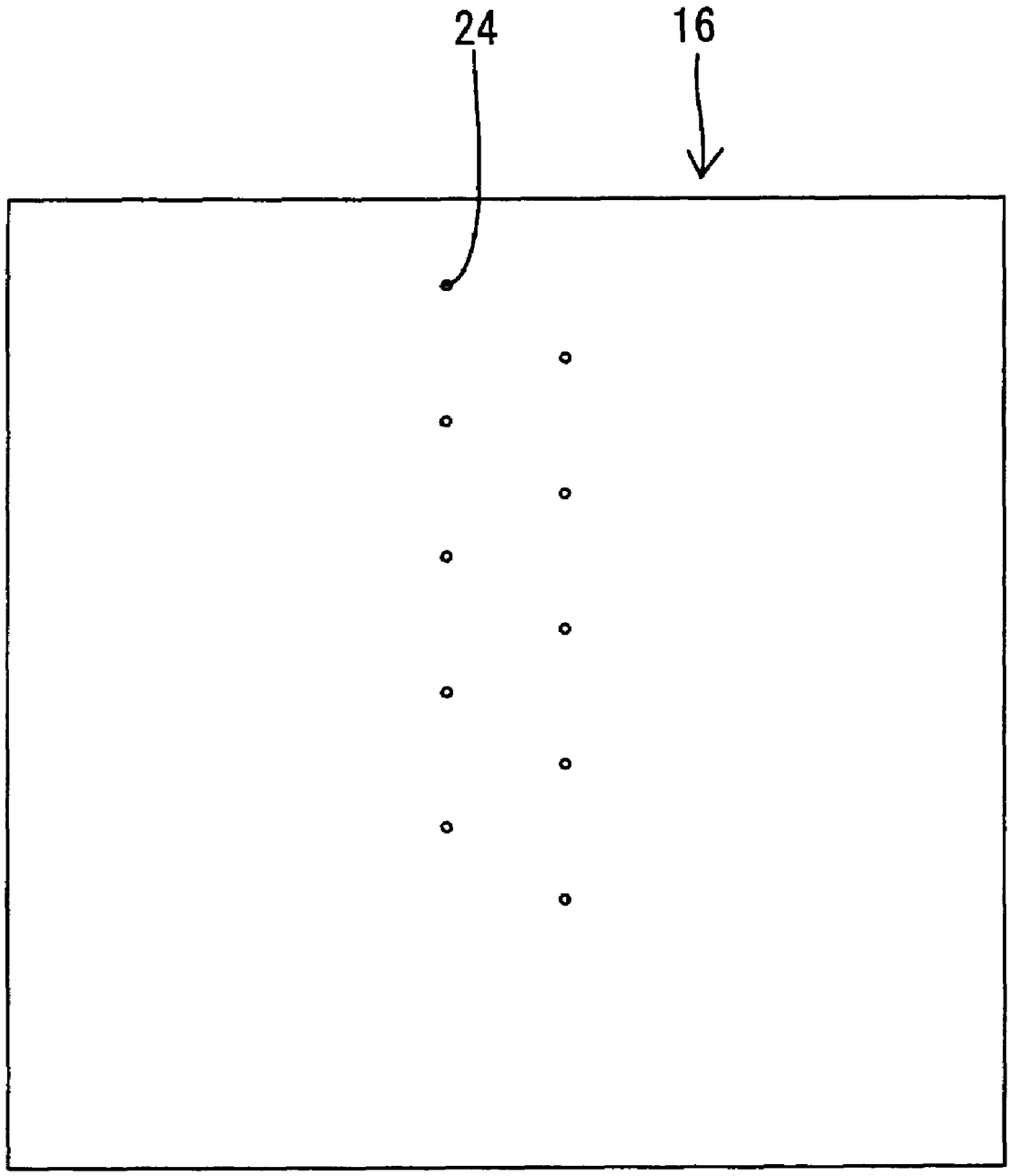
FIG. 13 is a plan view of a nozzle plate.

The nozzle plate 16 is formed by performing a blanking operation carried out by using an excimer laser, on the polyimide resin material, such that the nozzles 24 are formed at respective positions so as to correspond to the respective nozzle passages 23, as shown in FIG. 13.

Figure 14A:
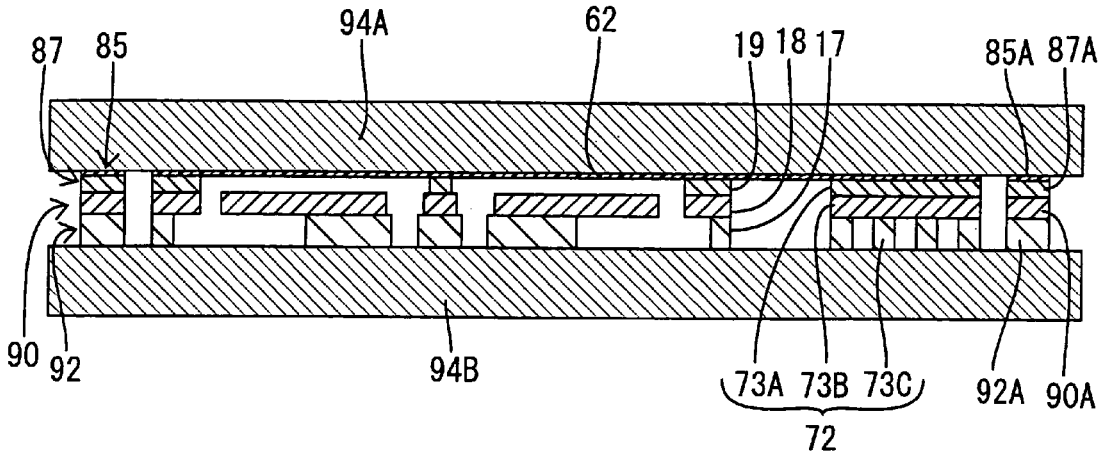
FIG. 14A is a cross sectional view showing a state in which metal plate members for the flow-passage unit and metal plate members for the heat dissipating member are simultaneously bonded to the oscillating plate.

After the bonding surfaces of the respective plate members 85, 87, 90, 92 are coated with an epoxy-type thermosetting adhesive, those plates 85, 87, 90, 92 are superposed on one another while they are positioned relative to one another, as shown in FIG. 14A. The thus superposed plates 85, 87, 90, 92 are pressure-tightly sandwiched by and between jigs 94A, 94B, and are heated so as to cure the adhesive. Accordingly, the superposition and bonding of the oscillating plate 62, the pressure-chamber plate 19, the flow-passage plate 18, and the manifold plate 17 which are located at a left-side part of FIG. 14A (at one of longitudinally opposite portions of the oscillating plate 62 on the side of the flow-passage unit 13), and the superposition and bonding of the oscillating plate 62, the first through third heat dissipating plates 73A-73C which are located at a right-side part of FIG. 14A (at the other of the longitudinally opposite portions of the oscillating plate 62 on the side of the heat dissipating member 72) can be simultaneously carried out. Thus, a portion of the flow-passage unit 13 and the heat dissipating member 72 are formed and bonded to one of the opposite surfaces of the oscillating plate 62, to thereby form an integral body.

Figure 14B:
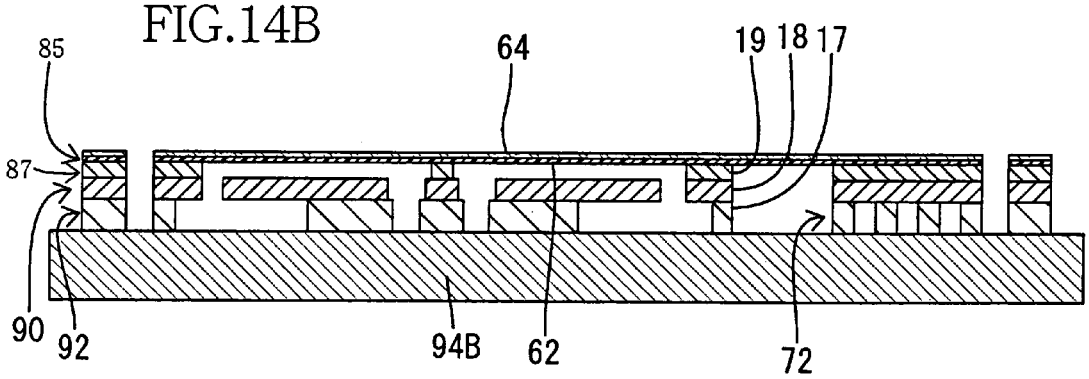
FIG. 14B is a cross sectional view showing a state in which an insulating layer is formed.

Next, as shown in FIG. 14B, the insulating layer 64 is formed by stacking the insulating material such as alumina on the entirety of the upper surface of the plate member 85 which includes the oscillating plate 62, according to the aerosol deposition (AD) method, sol-gel method, sputtering method, or CVD (Chemical Vapor Deposition) method, for instance.

Figure 14C:
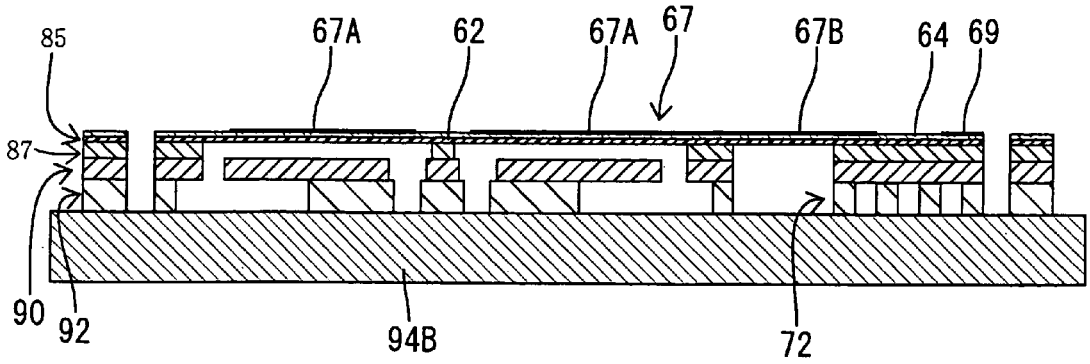
FIG. 14C is a cross sectional view showing a state in which an electrode pattern and external electrodes are formed.

Then, as shown in FIG. 14C, the electrode pattern 67 and the external electrodes 69 are formed on the upper surface of the insulating layer 64 by the above-described photolithography etching method, for instance.

Figure 15A:
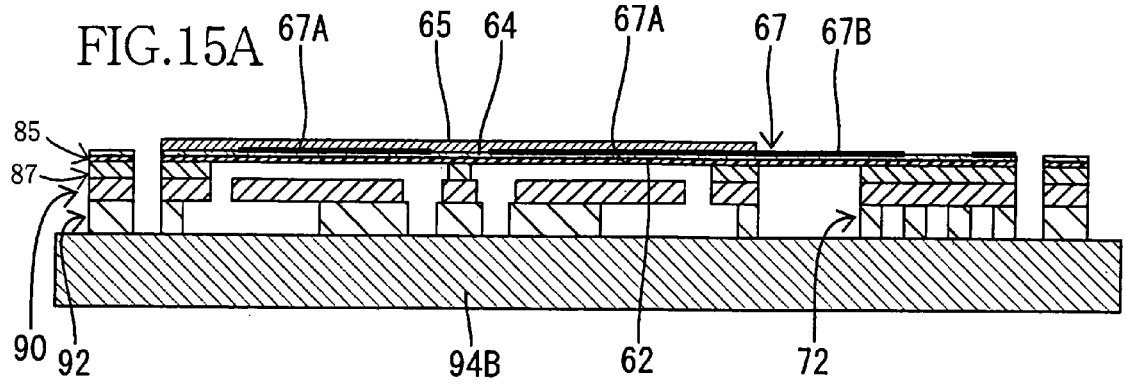
FIG. 15A is a cross sectional view showing a state in which a piezoelectric material layer is formed.

Subsequently, as shown in FIG. 15A, the piezoelectric material layer 65 is formed by stacking the piezoelectric material such as the lead zirconium titanate (PZT) on the insulating layer 64 and the electrode pattern 67, according to the aerosol deposition (AD) method, sol-gel method, sputtering method, CVD method, or hydrothermal synthesis, for instance.

Further, on the upper surfaces of the piezoelectric material layer 65 and the insulating layer 64, the upper common electrode 68 and the connecting portion which extends from the same 68 are formed by the above-described photolithography etching method, for instance.

Figure 15B:
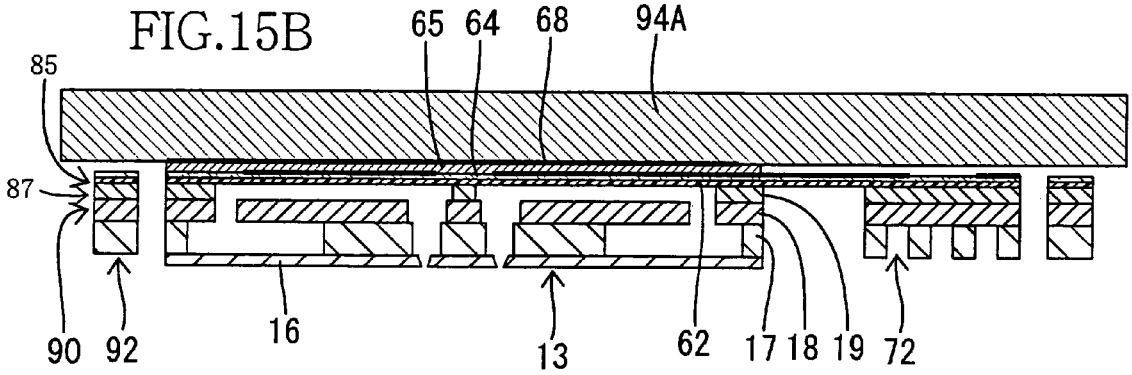
FIG. 15B is a cross sectional view showing a state in which the nozzle plate is bonded.

Subsequently, as shown in FIG. 15B, the nozzle plate 16 is bonded by using the thermosetting adhesive to the lower surface of the manifold plate 17.

Figure 15C:
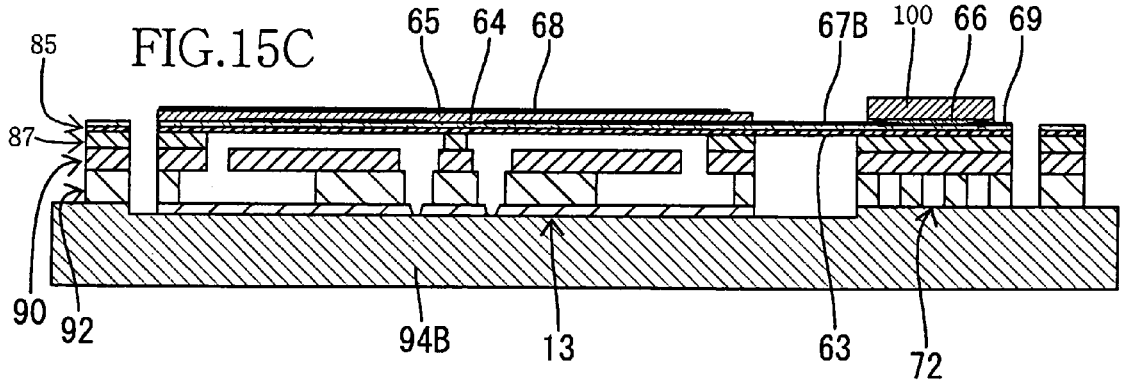
FIG. 15C is a cross sectional view showing a state in which a drive circuit is mounted.

Thereafter, as shown in FIG. 15C, the drive circuit (IC) 100 is bonded using the insulating adhesive 66 to the distal end portion of the extending portion 63 of the oscillating plate 62 with the insulating layer 64 therebetween. Further, the drive circuit (IC) 100 is connected by reflow soldering, for instance, to the connecting portions 67B of the electrode pattern 67, the connecting portion of the upper common electrode 68, and the external electrodes 69.

Figure 15D:
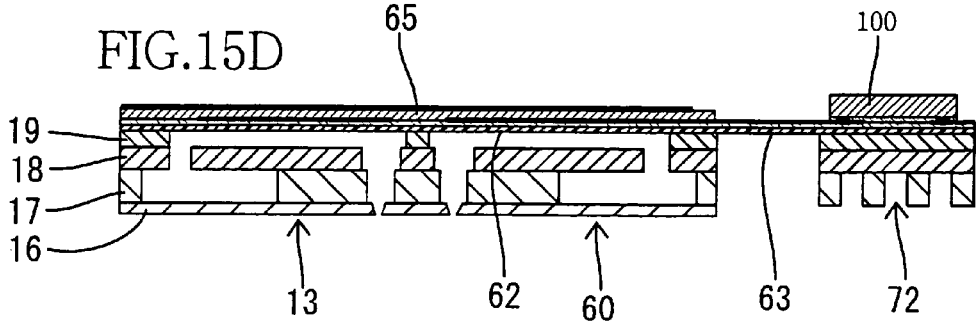
FIG. 15D is a cross sectional view showing a state in which frame members have been removed.

Then, as shown in FIG. 15D, the connecting portions 85B of the plate member 85, the connecting portions 87B, 87C of the plate member 87, the connecting portions 90B, 90C of the plate member 90, and the connecting portions 92B, 92C of the plate member 92 are removed so as to separate the frame members 85A, 87A, 90A, 92A. The separation of the frame members 85A, 87A, 90A, 92A is carried out, for instance, by applying a shearing force using dies having an edge corresponding to cutting line or lines. Thus, the liquid delivering apparatus 60 of the present embodiment is produced.

In the illustrated fourth embodiment, the heat dissipating member 72 is provided in the vicinity of the drive circuit (IC) 100 which is mounted indirectly on the extending portion 63 of the oscillating plate 62 with the insulating adhesive 66 and the insulating layer 64 therebetween, so that the heat generated from the drive circuit (IC) 100 is dissipated from the heat dissipating member 72.

In the liquid delivering apparatus 60 constructed according to the illustrated fourth embodiment, the insulating member 64 formed of the ceramic material is superposed on the oscillating plate 62 formed of the metal material and the drive circuit (IC) 100 is mounted on the insulating layer 64 via the adhesive 66 while the heat dissipating member 72 is bonded to the above-indicated one of the opposite surfaces of the oscillating plate 62 which is opposite to the above-indicated the other surface thereof on which the drive circuit (IC) 100 is indirectly mounted. According to this arrangement, the heat generated from the drive circuit (IC) 100 can be efficiently transmitted to the heat dissipating member 72 through the metallic oscillating plate 62 and the ceramic insulating layer 64 which have good thermal conductivity.

In the liquid delivering apparatus 60 constructed according to the illustrated fourth embodiment, the insulating layer 64 formed of the ceramic material having the insulating property is formed on the oscillating plate 62 formed of the metal material, and the piezoelectric material layer 65 and the electrode pattern 67 for applying the electric field to the same 65 are formed on the insulating layer 64. According to this arrangement, the electrode pattern 67 and the oscillating plate 62 can be insulated from each other with high reliability.

Since the heat dissipating member 72 and the flow-passage unit 13 are formed from the same metal material, the pre-processed members for the heat dissipating member 72 and the pre-processed members for the flow-passage unit 13 can be made common to each other, leading to a reduction in the manufacturing cost of the apparatus 60.

The flow-passage unit 13 is formed by stacking the plurality of metal plate members (87, 90, 92) and the heat dissipating member 72 is also formed by stacking the plurality of metal plate members (87, 90, 92), so that the formation of the flow-passage unit 13 and the formation of the heat dissipating member 72 can be simultaneously carried out, whereby the number of steps required in producing the apparatus 60 can be reduced.

The plurality of heat dissipating recesses 74 formed in the outer surface of the heat dissipating member 72 are effective to increase the surface area of the heat dissipating member 72, so that the heat is dissipated from the same 72 with high efficiency.

Further, the heat dissipating member 72 is held by the casing 75 so as to be exposed to the outer surface of the casing 75, assuring good heat dissipation.

Since the metal plates (87, 90, 92) give the respective plates 19, 18, 17 of the flow-passage unit 13 and the respective plates 73A, 73B, 73C of the heat dissipating member 72, the bonding of the plates 19, 18, 17 to the oscillating plate 62 and the bonding of the plates 73A, 73B, 73C to the oscillating plate 62 can be carried out simultaneously in one step, effectively reducing the number of steps required in producing the apparatus 60. In the illustrated fourth embodiment, the nozzle plate 16 is bonded to the lower surface of the manifold plate 17 after the upper common electrode 68 has been formed on the piezoelectric material layer 65. However, the nozzle plate 16 may be bonded to the manifold plate 17 which gives the plate member 92 when the plate members 85, 87, 90, 92 are superposed on and bonded to one another at the step shown in FIG. 14A. In this case, it is desirable that the pre-processed member of the nozzle plate 16 is a metal plate in which the nozzles 24 are formed by etching. The above-described method of producing the liquid delivering apparatus 60 according to the fourth embodiment is applicable in producing the liquid delivering apparatuses 10, 40, 50 according to the illustrated first, second, and third embodiment, respectively.

Fifth Embodiment

By referring next to FIG. 16, there will be described a liquid delivering apparatus 60A constructed according to a fifth embodiment of the invention. In this fifth embodiment, the same reference numerals as used in the illustrated first and fourth embodiments are used to identify the corresponding components, and a detailed explanation of which is not given.

Figure 16:
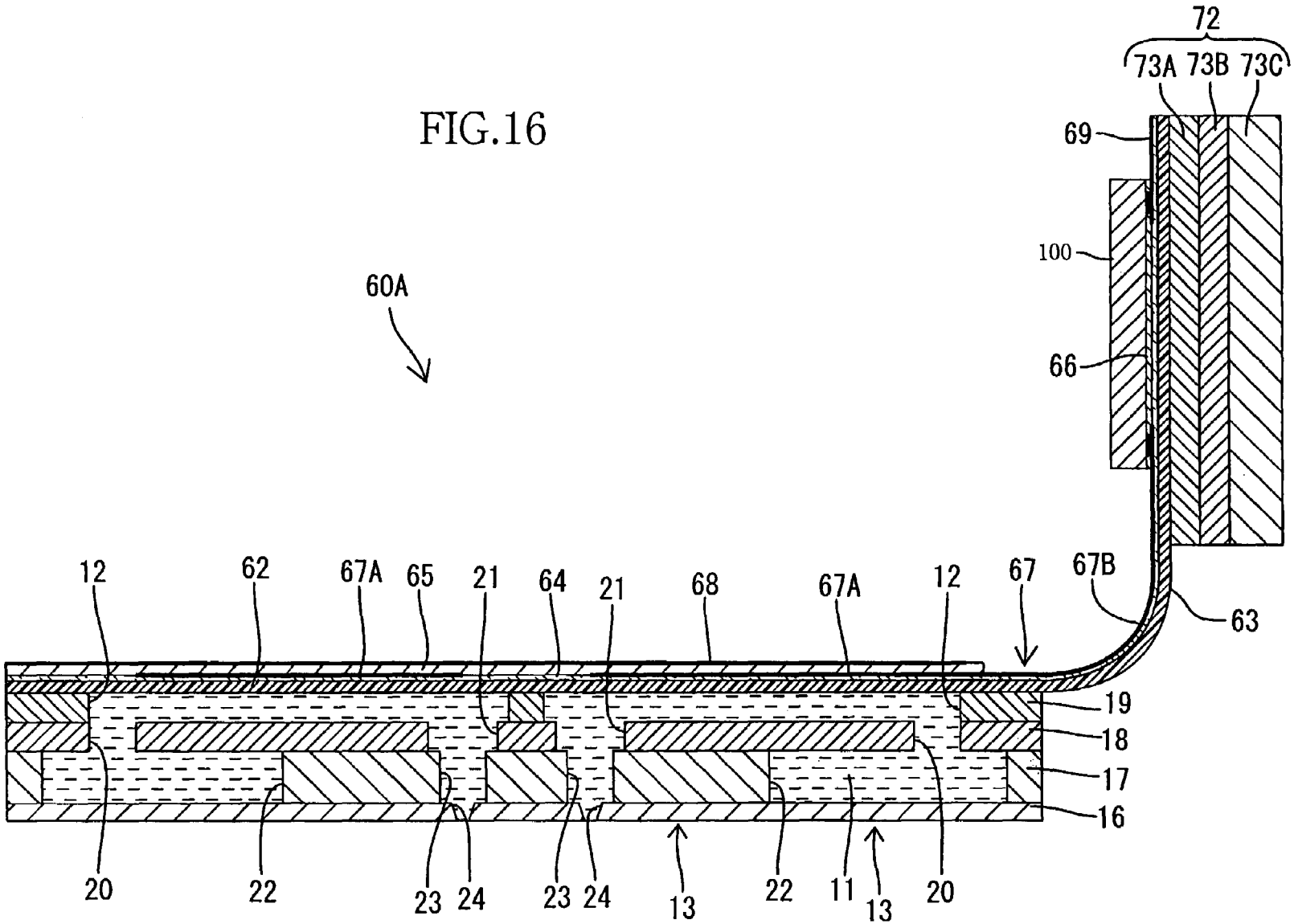
FIG. 16 is a cross sectional view of a liquid delivering apparatus constructed according to a fifth embodiment of the invention, taken along the longitudinal direction of the pressure chambers.

In the liquid delivering apparatus 60A, the extending portion 63 of the oscillating plate 62 is folded at an angle of approximately 90 degrees, as shown in FIG. 16. The liquid delivering apparatus 60A is accommodated within a casing (not shown) of the ink-jet recording head with the extending portion 63 being folded as described above. This arrangement is effective to reduce an area of the apparatus 60A as seen in its plan view, resulting in a reduction in the size of the apparatus 60A. The heat dissipating member 72 of the liquid delivering apparatus 60A of this fifth embodiment is not provided with the heat dissipating recesses 74 which are formed in the heat dissipating member 72 of the apparatus of FIG. 7.

Sixth Embodiment

Figure 17:
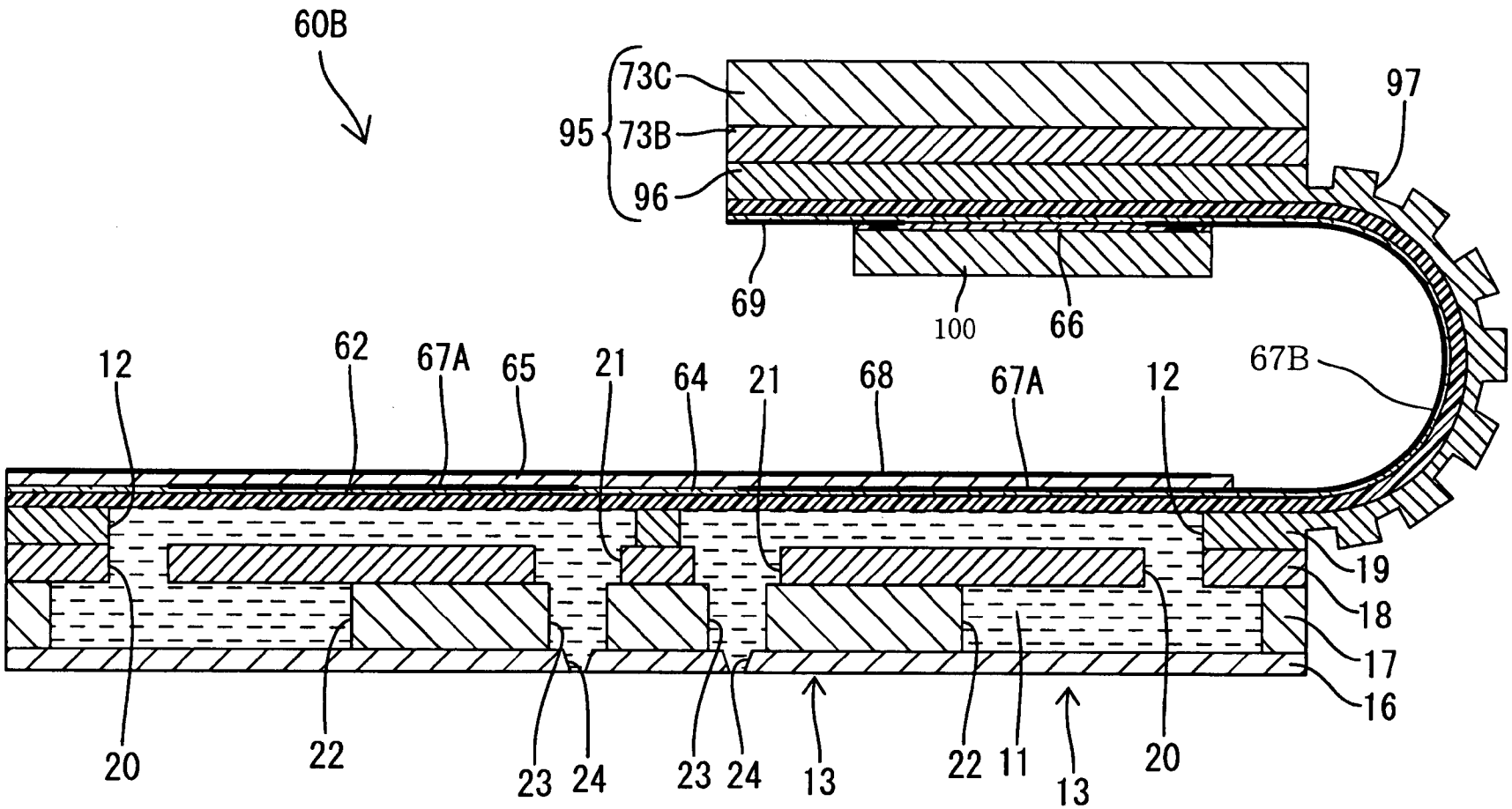
FIG. 17 is a cross sectional view of a liquid delivering apparatus constructed according to a sixth embodiment of the invention, taken along the longitudinal direction of the pressure chambers.

There will be next explained a liquid delivering apparatus 60B constructed according to a sixth embodiment of the invention by referring to FIG. 17. In this sixth embodiment, the same reference numerals as used in the illustrated first and fourth embodiments are used to identify the corresponding components, and a detailed explanation of which is dispensed with.

The liquid delivering apparatus 60B of this sixth embodiment has a heat dissipating member 95 which is constituted by a first heat dissipating plate 96 and the second and third heat dissipating plates 73B, 73C. The second and third heat dissipating plates 73B, 73C are provided only on the distal end portion of the extending portion 63 while the third heat dissipating plate 96 is provided so as to extend over the entirety of the extending portion 63 and connected at its one end to the pressure-chamber plate 19 of the flow-passage unit 13. A plurality of heat dissipating recesses 97 each in the form of a groove are formed in the outer surface of the first heat dissipating plate 96 located between the flow-passage unit 13 and the second heat dissipating plate 73B, such that the heat dissipating recesses 97 extend along a direction parallel to the rows of the nozzles 24. The heat dissipating recesses 97 are effective to not only increase the heat dissipating effect, but also enable the extending portion 63 to be curved with a stable curvature. As described above, the configurations or structures of the heat dissipating member and the heat dissipating recesses may be suitably changed.

While the preferred embodiments of the present invention have been described above, for illustrative purpose only, it is to be understood that the invention is not limited to the details of the illustrated embodiments, but may be embodied with various changes and modifications, which may occur to those skilled in the art, without departing from the spirit and scope of the invention defined in the attached claims.

In each of the illustrated embodiments, the liquid delivering apparatus in the form of the ink-jet recording head has been described. The principle of the present invention is equally applicable to a micro pump which delivers liquid by utilizing piezoelectric ceramic.

The liquid delivering apparatus according to the present invention delivers, from the nozzles (openings) communicating with the respective pressure chambers, the liquid in various states such as droplet and mist. Further, the apparatus delivers the liquid by ejection, emission, jetting, injection, etc.

What is claimed is:

1. A liquid delivering apparatus, comprising:

a flow-passage unit including an opening and a pressure chamber which accommodates liquid and which communicates with the opening, the flow-passage unit including a first outer side edge and a second outer side edge opposite the first outer side edge;

an oscillating plate which partially defines the pressure chamber and which includes an extending portion that initially extends from the first outer side edge of the flow-passage unit to an outside thereof so as to be away from the second outer side edge;

a piezoelectric material layer which is one of directly and indirectly stacked on the oscillating plate and which deforms upon application of an electric field thereto so as to oscillate the oscillating plate for delivering the liquid from the pressure chamber through the opening;

an electrode pattern and a drive circuit which apply the electric field to the piezoelectric material layer, the electrode pattern being one of directly and indirectly provided on the oscillating plate, the drive circuit is one of directly and indirectly mounted on the extending portion of the oscillating plate; and a heat dissipating member provided on the extending portion in the vicinity of the drive circuit.

2. The liquid delivering apparatus according to claim 1, wherein the electrode pattern includes an electrode which has a size smaller than that of the pressure chamber and a connecting portion which extends from one end of the electrode and is connected to the drive circuit.

3. The liquid delivering apparatus according to claim 1, wherein the extending portion is folded so as to be opposed to the flow-passage unit.

4. The liquid delivering apparatus according to claim 1, wherein the flow-passage unit has a generally rectangular shape and the extending portion of the oscillating plate initially extends from the first outer side edge of the flow-passage unit to the outside thereof so as to be away from the second outer side edge.

5. The liquid delivering apparatus according to claim 1, comprising a plurality of pressure chambers which include the pressure chamber and which are arranged in a row, the flow-passage unit having a generally rectangular shape, the extending portion of the oscillating plate initially extending from the first outer side edge of the flow-passage unit which is parallel to the row of the plurality of pressure chambers and to the outside thereof so as to be away from the second outer side edge.

6. The liquid delivering apparatus accc1rding to claim 1, wherein the heat dissipating member is bonded to one of opposite surfaces of the oscillating plate which is opposite to the other of the opposite surfaces on which the drive circuit is one of directly and indirectly mounted.

7. The liquid delivering apparatus according to claim 6, wherein the heat dissipating member is formed of a metal material which is the same as a metal material which constitutes at least a part of the flow-passage unit.

8. The liquid delivering apparatus according to claim 7, wherein the flow-passage unit is formed of a plurality of metal plates which are stacked on one another and each of which is formed with at least one hole for forming at least one flow passage, and the heat dissipating member is formed of a plurality of metal plates which are stacked on one another and which are the same as the plurality of metal plates for providing the flow-passage unit.

9. The liquid delivering apparatus according to claim 1, wherein the heat dissipating member has a plurality of heat dissipating recesses formed on a surface thereof.

10. The liquid delivering apparatus according to claim 1, further comprising a casing in which the flow-passage unit and the oscillating plate are accommodated and which holds the heat dissipating member so as to be exposed to an exterior of the casing.

11. The liquid delivering apparatus according to claim 1, wherein the oscillating plate is formed of an electrically conductive material and the piezoelectric material layer is formed so as to be superposed at least on a portion of a region of the oscillating plate, which region corresponds to the pressure chamber, the electrode pattern being superposed on the piezoelectric material layer, the liquid delivering apparatus being arranged such that the electric field is applied between the electrode pattern and the oscillating plate.

12. The liquid delivering apparatus according to claim 11, wherein the piezoelectric material layer is formed at least on a region of the oscillating plate which corresponds to the electrode pattern.

13. The liquid delivering apparatus according to claim 1, wherein the oscillating plate is formed of an electrically conductive material and the piezoelectric material layer is formed so as to be superposed at least on a portion of a region of the oscillating plate, which region corresponds to the pressure chamber, the liquid delivering apparatus further comprising an electrically insulating layer formed on at least a portion of a region of the oscillating plate on which the piezoelectric material layer is not formed, the electrode pattern being formed so as to extend over both of the piezoelectric material layer and the electrically insulating layer, the liquid delivering apparatus being arranged such that the electric field is applied between the electrode pattern and the oscillating plate.

14. The liquid delivering apparatus according to claim 13, wherein the piezoelectric material layer is formed at least on a portion of a region of the oscillating plate, which region corresponds to the electrode pattern, and the electrically insulating layer is formed at least on the other portion of the region.

15. The liquid delivering apparatus according to claim 1, wherein the oscillating plate is formed of an electrically insulating material and the piezoelectric material layer is formed so as to be superposed at least on a portion of a region of the oscillating plate, which region corresponds to the pressure chamber, with a lower electrode being interposed between the piezoelectric material layer and the oscillating plate, the electrode pattern being superposed on the piezoelectric material layer, the liquid delivering apparatus being arranged such that the electric field is applied between the electrode pattern and the lower electrode.

16. The liquid delivering apparatus according to claim 15, wherein the piezoelectric material is formed at least on a region of the oscillating plate in which the electrode pattern and the lower electrode overlap each other.

17. The liquid delivering apparatus according to claim 1, further comprising an electrically insulating layer which is formed on the oscillating plate by using a ceramic material having an electrically insulating property, the drive circuit being mounted on the extending portion of the oscillating plate with the electrically insulating layer therebetween.

18. The liquid delivering apparatus according to claim 17, wherein the electrode pattern is formed on the electrically insulating layer and the piezoelectric material layer is formed at least on a portion of a region of the electrically insulating layer, which region corresponds to the pressure chamber, with the electrode pattern being interposed therebetween, the liquid delivering apparatus further comprising an upper electrode formed so as to be superposed on the piezoelectric material layer and being arranged such that the electric field is applied between the upper electrode and the electrode pattern.

19. An ink-jet recording head including the liquid delivering apparatus according to claim 1, wherein the liquid stored in the pressure chamber is ink which is delivered to an exterior of the apparatus through the opening communicating with the pressure chamber.

20. A liquid delivering apparatus, comprising:

a flow-passage unit including an opening and a pressure chamber which accommodates liquid and which communicates with the opening, the flow-passage unit including a first outer side edge and a second outer side edge opposite the first outer side edge;

an oscillating plate which partially defines the pressure chamber and which includes an extending portion that initially extends from the first outer side edge of the flow-passage unit to an outside thereof so as to be away from the second outer side edge;

a piezoelectric material layer which is stacked on the oscillating plate and which deforms upon application of an electric field thereto so as to oscillate the oscillating plate for delivering the liquid from the pressure chamber through the opening;

an electrode pattern and a drive circuit which apply the electric field to the piezoelectric material layer, the electrode pattern being one of directly and indirectly provided on the oscillating plate while the drive circuit is one of directly and indirectly mounted on the extending portion of the oscillating plate; and an electrically insulating layer which is formed on the oscillating plate by using a ceramic material having an electrically insulating property, the drive circuit being mounted on the extending portion of the oscillating plate with the electrically insulating layer therebetween.

21. The liquid delivering apparatus according to claim 20, wherein the electrode pattern is formed on the electrically insulating layer and the piezoelectric material layer is formed at least on a portion of a region of the electrically insulating layer, which region corresponds to the pressure chamber, with the electrode pattern being interposed therebetween, the liquid delivering apparatus further comprising an upper electrode formed so as to be superposed on the piezoelectric material layer and being arranged such that the electric field is applied between the upper electrode and the electrode pattern.

22. A liquid delivering apparatus, comprising:

a flow-passage unit including an opening and a pressure chamber which accommodates liquid and which communicates with the opening, the flow-passage unit including a first outer side edge and a second outer side edge opposite the first outer side edge;

an oscillating plate which partially defines the pressure chamber and which includes an extending portion that initially extends from the first outer side edge of the flow-passage unit to an outside thereof so as to be away from the second outer side edge;

a piezoelectric material layer which is stacked on the oscillating plate and which deforms upon application of an electric field thereto so as to oscillate the oscillating plate for delivering the liquid from the pressure chamber through the opening; and an electrode pattern and a drive circuit which apply the electric field to the piezoelectric material layer, wherein the liquid delivering apparatus further comprises:

an electrically insulating layer superposed on the oscillating plate at both of a region of the oscillating plate overlapping the flow-passage unit and a region of the oscillating plate corresponding to the extending portion, wherein the drive circuit is mounted on the extending portion of the oscillating plate while the electrode pattern is superposed on the electrically insulating layer at both of the region of the oscillating plate overlapping the flow-passage unit and the region of the oscillating plate corresponding to the extending portion, wherein the piezoelectric material layer is superposed on the electrically insulating layer at the region of the oscillating plate overlapping the flow-passage unit, with the electrode pattern interposed between the electrically insulating layer and the piezoelectric material layer, wherein the liquid delivering apparatus further comprises:

an upper electrode superposed on the piezoelectric material layer; and an upper-electrode connecting portion which is superposed on the electrically insulating layer at the region of the oscillating plate corresponding to the extending portion, for connecting the upper electrode and the drive circuit to each other, and wherein the liquid delivering apparatus is arranged such that the electric field is applied between the electrode pattern and the upper electrode.

* * * * *